US010654547B2

(12) United States Patent
Miller

(10) Patent No.: US 10,654,547 B2
(45) Date of Patent: May 19, 2020

(54) ADJUSTABLE FIN SYSTEM

(71) Applicant: Flying Fin Systems Pty Ltd, Margaret River (AU)

(72) Inventor: Glenndin G. Miller, Margaret River (AU)

(73) Assignee: FLYING FIN SYSTEMS PTY LTD, Margaret River (AU)

( * ) Notice: Subject to any disclaimer, the term of this patent is extended or adjusted under 35 U.S.C. 154(b) by 0 days.

(21) Appl. No.: 15/760,215

(22) PCT Filed: Nov. 13, 2015

(86) PCT No.: PCT/AU2015/050710

§ 371 (c)(1),
(2) Date: Mar. 14, 2018

(87) PCT Pub. No.: WO2017/045011

PCT Pub. Date: Mar. 23, 2017

(65) Prior Publication Data

US 2018/0251197 A1 Sep. 6, 2018

(30) Foreign Application Priority Data

Sep. 15, 2015 (AU) ..... 2015903750

(51) Int. Cl.

| | |
|---|---|
| ***B63B 35/79*** | (2006.01) |
| ***B63B 35/00*** | (2006.01) |
| ***B63B 1/00*** | (2006.01) |

(52) U.S. Cl.

CPC ..... *B63B 35/7926* (2013.01); *B63B 35/793* (2013.01); *B63B 35/7953* (2013.01); *B63B 2035/7903* (2013.01)

(58) Field of Classification Search

CPC ..... B63B 1/00; B63B 35/79; B63B 35/793; B63B 35/73; B63B 35/81; B63B 35/85; B63B 3/00; B63B 3/38; B63B 35/7909

(Continued)

(56) References Cited

U.S. PATENT DOCUMENTS

| | | | | |
|---|---|---|---|---|
| 3,659,300 | A | 5/1972 | Johnson | |
| 6,752,674 | B2 * | 6/2004 | Jolly | B63B 35/793 441/79 |

(Continued)

FOREIGN PATENT DOCUMENTS

| | | |
|---|---|---|
| EP | 0079113 A1 | 5/1983 |
| EP | 3145806 A1 | 3/2017 |

(Continued)

OTHER PUBLICATIONS

International Search Report issued in International Application No. PCT/AU2015/050710, dated Feb. 15, 2016, 3 pages.

(Continued)

*Primary Examiner* — Lars A Olsen

(74) *Attorney, Agent, or Firm* — Miller Nash Graham & Dunn LLP

(57) ABSTRACT

A fin for use on a surfboard or another watercraft comprising a fin section that can be releasably coupled to the base of the fin, and the fin section can be slidably adjusted relative to the base in a direction towards the leading edge or the trailing edge of the fin. Following adjustment, the position of the fin section can be secured to the base with one or more locking means.

23 Claims, 22 Drawing Sheets

(58) Field of Classification Search
USPC ..... 441/79
See application file for complete search history.

(56) References Cited

U.S. PATENT DOCUMENTS

| | | | | |
|---|---|---|---|---|
| 8,113,896 | B2 | 2/2012 | Wang et al. | |
| 9,926,051 | B2 * | 3/2018 | Miller | B63B 35/793 |
| 2003/0220030 | A1 | 11/2003 | Jolly | |
| 2005/0260903 | A1 | 11/2005 | Batt | |
| 2010/0068956 | A1 | 3/2010 | Anton | |
| 2013/0012084 | A1 | 1/2013 | Higgins et al. | |
| 2013/0092071 | A1 | 4/2013 | Andrieu et al. | |
| 2013/0189886 | A1 * | 7/2013 | Yeh | B63B 35/793 441/79 |
| 2015/0183496 | A1 | 7/2015 | Schultz, III | |

FOREIGN PATENT DOCUMENTS

| | | | |
|---|---|---|---|
| JP | 3109821 | U | 6/2005 |
| WO | 2007048172 | A1 | 5/2007 |

OTHER PUBLICATIONS

Extended European Search Report issued in European Patent Application No. 15903770.4, dated Apr. 2, 2019, 8 pages.

* cited by examiner (A)

(B)

(C)

(A)

(A)

(B)

ADJUSTABLE FIN SYSTEM

CROSS-REFERENCE TO RELATED APPLICATIONS

This application is a national stage filing under 35 U.S.C. § 371 of International Application No. PCT/AU2015/050710, filed Nov. 13, 2015, entitled "ADJUSTABLE FIN SYSTEM," and claims priority from Australian Provisional Patent Application No. 2015903750, filed Sep. 15, 2015, the disclosures of both of which are incorporated herein by reference in their entirety.

TECHNICAL FIELD

The present invention relates to an adjustable fin for a surfboard. More particularly, the invention relates to a surfboard fin having a fin section that can be adjusted relative to a base in a direction towards the leading edge or trailing edge of the fin.

BACKGROUND ART

The following discussion of the background art is intended to facilitate an understanding of the present invention only. The discussion is not an acknowledgement or admission that any of the material referred to is or was part of the common general knowledge as at the priority date of the application.

A surfboard, stand-up paddleboard (SUP), or similar type of board for use in water sports and other activities can be viewed in one sense as a summation of hydrodynamic surfaces. The surface of the bottom of the board in contact with water generates lift and affects speed. More importantly though, it is the fins working in collaboration with rail and bottom contour that most influence the feel of the board when changing direction. Since the form shape of surfboards including the rails and bottom surface has undergone finer and finer adjustments over the past few decades, the largest gains that can still be made to a board's performance is in fin modification.

Predominant factors that influence the effect of the fins include (i) foil shape, and the curve from leading to trailing edge as it changes from base to tip; (ii) template shape, which is the combination of depth, width, and rake that make up the profile of the fin; (iii) stability and flex, which can depend on the materials from which a fin is made; and (iv) fin placement, which comprises tow and camber of the fins, the distance between the fins, and the distance of the fins from the rear of the board.

Foils comprise surfaces which affect lift and drag. Where one surface of a foil is curved and the other, predominantly flat (a 'flat foil'), it takes less effort (drag) for liquid to flow past the flat surface as the path of least resistance than the curved surface. As a result, more water will flow past the flat surface of the foil creating an area of high pressure. Conversely, an area of low pressure is created adjacent to the curved surface of the foil. This difference in pressure creates lift towards the curved side of the foil. The more curve a foil has, the more drag it induces over the curved surface which means that a foil with greater curvature will have more lift at lower speeds. The problem is at higher speeds that additional drag will develop turbulence and stall the flow across the foil. Side fins on a surfboard are usually flat foils which are oriented with the flat face of the foil facing towards the centre or stringer of the board. The resulting pressure differential assists to pull the board fins and rail of the surfboard down into the water. Therefore, thicker, more curved foils are preferred by surfers for slow waves, and flatter, finer foils for faster waves.

Template shape affects stability and control. As an example, fins that are deeper, with a wider base and more rake provide greater stability and control as a result of a relatively large surface area. However, more surface area causes greater drag and slows a board down. As a generalisation known amongst surfers, fins with a greater surface area are more preferred for steep and heavy waves, choppy and irregular conditions, for heavier surfers, and/or surfers with a flowing style. Alternatively, fins with less surface area are more preferred for sloped, clean and glassy waves, for lighter surfers, and/or surfers that exercise extreme and radical manoeuvres.

The flex of a surfboard fin can affect stability in turns. For example, a flexible tip on a fin can dampen or smooth out some of the bite when a surfer changes direction on a surf board. But a stable fin base is crucial to prevent or minimise turbulence which can generate drag and disturb the lift causing loss of fin control, making the board slow and out of control. Less flex can make turns more off a pivot.

'Toe' can be considered in terms of the angle the base of the side fins are pointed in towards the centre of the board relative to the leading edge and trailing edge at the base. 'Cant' can be considered in terms of the angle the body of a fin is set at relative to the bottom surface of the board in a plane perpendicular to the direction of the stringer. Both toe and cant affect the 'angle of attack' of fin foils in their movement through the water. A greater angle forces more water flow around the outside curved surface of the foil at lower speeds making it easier to initiate turns on slower waves. However, too much angle at higher speeds increases turbulence and drag slowing down the board.

Since the introduction of removable fins about two decades ago by FCS®, there has been a greater interest from surfers and particularly professional surfers in fin placement in addition to the other factors described above. While fin placement is often left to convention, for example, with many board shapers following the benchmark for approximate location set by Simon Anderson more than thirty years ago, many other board shapers have their personal preference for each surf board model they shape. There are, however, subtle differences in most boards and in all riders. An adjustment of the position of a fin as small as a 4 mm fin movement fore or aft in either or both the centre fin or side fins can have a profound effect on the performance of a board, similar to a change of fin size or template. In general terms, moving a fin towards the rear of the board will stiffen the board, allowing it to handle greater speed and irregular water conditions. Moving a fin forward will loosen the board allowing it to turn on a tighter radius for easier changes in direction, and is preferable in glassy water conditions and short beach surf breaks.

Removable fin arrangements and systems have therefore been designed, with some available for purchase, which allow a surfer to adjust the position of a fin on their surfboard, and in some cases, even the tow and cant of the fin. However, these removable and adjustable fin arrangements commonly attach to their own unique and custom fin box or plug requiring a new board or modifications to an existing board. Many of these adjustable fin arrangements also require tools to be carried by the surfer to adjust the position of the fins on the board. As a result, there has been a relatively small uptake of these adjustable fin arrangements by the millions of surfers and other board riders around the world.

SUMMARY OF THE INVENTION

First Aspect of the Invention

In a first aspect, the invention provides an adjustable fin for use on a surfboard, the adjustable fin comprising:

a base comprising:

at least one mounting means for mounting the adjustable fin on to a surfboard; and the base further comprising an adjustment member;

a fin section comprising:

two outer fin surfaces which meet at a leading edge and a trailing edge;

the fin section further comprising an opening to an internal cavity within the fin section, the internal cavity within the fin section configured to house the adjustment member of the base and enable slidable movement of the adjustment member in a direction towards the leading edge or the trailing edge; and the fin section further comprising a locking means which can releasably couple to the adjustment member at one of two or more locking positions thereby preventing slidable movement of the adjustment member;

wherein the fin section can be adjusted relative to the base by uncoupling the locking means from the adjustment member at a first locking position, slidably moving the adjustment member through the internal cavity, and releasably coupling the locking means to the adjustment member at a second locking position.

In a preferred embodiment, the base is coupled to the fin section by at least a portion of a sliding joint. The at least one sliding joint preferably comprises at least a wall and a portion of the base of a tongue slidably engaged with at least a wall and a portion of the base of a groove. The at least one sliding joint more preferably comprises at least the walls and a portion of the base of a tongue adjacent to each wall, slidably engaged with at least the walls of a groove and a portion of the base of the groove adjacent to each wall of the groove. The sliding tongue and groove joint, or portion of the sliding tongue and groove joint, are preferably complementary in shape and form to couple and allow slidable movement of the tongue or a portion of the tongue, in the groove or at least a portion of the groove.

According to the first aspect of the invention, the base preferably comprises at least a wall and a portion of the base of a groove on either side of the adjustment member, and the fin section comprises at least the walls of the tongue and a portion of the base of the tongue. More preferably, the base preferably comprises at least a wall of the groove and a portion of the base of the groove adjacent to the wall, on either side of the adjustment member, and the fin section comprises at least the walls of a tongue and a portion of the base of the tongue adjacent to each wall. Even more preferably, the fin section comprises a wall and at least a portion of the base of the tongue adjacent to the wall, on opposing sides of the internal cavity and preferably within an indentation adjacent to, or at the opening to the internal cavity. Preferably the wall of a tongue does not extend beyond the opening to the internal cavity.

In a more preferred embodiment, the sliding joint comprises at least the walls or, more preferably, at least the 'cheeks' of a dovetail tongue slidably engaged with at least the walls of a sliding dovetail groove. A cheek of a dovetail tongue comprises at least a wall and a portion of the base of the dovetail tongue which may form a wedge shape. Preferably, the sliding joint comprises at least the walls or 'cheeks' of a dovetail tongue slidably engaged with at least the walls and, preferably, part of the floor adjacent to a wall, of a sliding dovetail groove.

The sliding joint preferably comprises a sliding dovetail joint, and the base comprises at least a wall, and preferably a portion of the base adjacent to the wall (which may be referred to as a cut-away), of a sliding dovetail groove on either side of the adjustment member, and the fin section comprises at least the walls and a portion of the base ('cheeks') of a dovetail tongue. The wall of a sliding dovetail groove preferably comprises the angle of the dovetail and at least a portion of the base (which may be referred to as a floor or bottom face) of the dovetail groove creating a dovetail corner through which a dovetail, or cheeks thereof, may slidably move. The cheeks of a dovetail tongue preferably include the wall or part of the wall of the dovetail, and a portion of the bottom surface or base of the dovetail which can slidably engage with the dovetail groove. The dovetail cheek may resemble a wedge shape extension, and the wall of a sliding dovetail groove may be in a form to slidably engage with the wedge-shaped extension. The fin section preferably comprises at least a wall and a portion of the base of the dovetail tongue on opposing sides of the internal cavity and adjacent to the opening to the internal cavity.

In a preferred embodiment, the base is releasably coupled to the fin section by at least one sliding joint. Preferably, the at least one sliding joint comprises at least the walls of a groove having at least one gap, and the base can be uncoupled from the fin section by slidable movement of at least the walls of the tongue into the gap. That is, the base can be uncoupled from the fin section by slidable movement of the at least walls and a portion of the base of the tongue into a gap in the at least walls and a portion of the base of the groove. Conversely, the base may be coupled to the fin section by passing the at least walls of the tongue through a gap in the at least walls of the groove and slidably moving the at least walls of the tongue along the at least walls of the groove. There is preferably two gaps through which two of at least walls of a tongue may pass through, following which the at least walls of the tongue may be slidably engaged with the at least walls of the groove.

The locking means can preferably be manipulated from an outer fin surface. In a preferred embodiment, the locking means comprises at least one knob which is accessible for a user at an outer fin surface of the fin section for manipulating the locking means, and wherein turning the knob uncouples the locking means from the adjustment member, or recouples the locking means to the adjustment member.

The adjustment member is preferably substantially planar, comprising a flat or substantially flat surface, and extends in a direction substantially contrary to the mounting means. Preferably, the planar adjustment member is between approximately 1 mm to 2 mm thick. This can allow the construction of a relatively thin adjustable fin of the invention which is preferable for reducing fin drag. The internal cavity of the fin section preferably comprises a slot configured to house the substantially planar adjustment member and through which the adjustment member can slidably move, or be removed from inside the internal cavity when separating the fin section from the base. More preferably, the adjustment member comprises three or more teeth, and a valley between two teeth forms a locking position. The peaks of the teeth may comprise a variety of shapes including pointed teeth peaks, or peaks rounded in shape or asymmetric in shape. Preferably, the three or more teeth point in a direction contrary to the mounting means. The adjustment member preferably comprises a first and a second end, wherein the first end is attached to the mounting means, and the three or more teeth are located at the second end of the adjustment member. The three or more teeth preferably point in a direction substantially contrary (that is in a substantially opposite direction) to the mounting means.

The opening to the internal cavity is preferably situated between the two outer fin surfaces. The length of the internal cavity within the fin section, measured from an end closest to the leading edge to an end closest to the trailing edge, and the length of the adjustment member measured along the same plane, will determine the maximum distance the fin section may be adjusted by slidable movement of the adjustment member towards the leading edge or the trailing edge, within the internal cavity. Preferably, the internal cavity permits up to approximately 10 mm to 30 mm of movement of the fin section relative to the base in a direction towards the leading edge or the trailing edge. More preferably, the internal cavity permits up to approximately 20 mm of movement of the fin section relative to the base in a direction towards the leading edge or the trailing edge. The length of slidable movement will depend on the size and shape of the fin section which will limit the length of the internal cavity possible within the fin section, and the shape and length of the adjustment member. Means for showing the user the position of the fin section relative to the base are also within the scope of the invention, for example, to enable a user to adjust two or more fins on a board equally.

The locking means preferably comprises a locking portion which is received at a locking position in a valley thereby coupling the locking means to the adjustment member and therefore the fin section to the base, and turning the knob moves the locking portion out of the valley and the locking position, thereby uncoupling the locking means from the adjustment member and enabling slidable movement of the adjustment member through the internal cavity. The locking portion is preferably a cam and even more preferably, the cam is not circular but is wedge shaped or of a shape wherein turning the locking means and therefore the cam approximately 90 degrees can move the portion of the cam that is in a locking position in a valley completely out of the valley. Following slidable movement of the adjustable member through the internal cavity, re-turning the knob can move the locking portion into the same or a different valley and a locking position, thereby recoupling the locking means to the adjustment member. Thus, a user can turn the knob and adjust the position of the fin section relative to the base when the adjustable fin is mounted to a surfboard. The knob and locking means may be constructed from a variety of materials. The knob may be constructed from the same material as the fin section or from other materials. For example, the locking means may additionally comprise rubber rings, and/or one or more screws or rivets to hold the mechanism or assembly together.

In one preferred embodiment, a portion of the knob protrudes form at least one outer fin surface and means the at least one knob can be finger turned by a user. Preferably, the portion of the knob protruding is in the form of a ridge.

In another preferred embodiment, the knob comprises a slot and an object partially inserted in the slot can be turned to turn the knob. The slot is preferably between 1.5 mm to 1.8 mm wide, and more preferably approximately 1.7 mm wide. The object preferably comprises a coin or other disc shaped object, a portion of which can be accommodated in the slot. This may be a coin such as an American dime, an Australian 10 cent piece, or another similarly shaped object. The knob comprising the slot may sit flush or not flush to an outer fin surface.

Other forms of the knob are considered to be within the scope of the invention comprising, for example, a foldable wing-type nut which can be unfolded from a position flush or almost flush to an outer fin surface, then turned by a user to turn the knob, and then refolded. In another example, a key can be inserted in a key hole in the knob to turn the knob.

Following slidable movement of the adjustment member through the internal cavity, re-turning the knob preferably can move the locking portion into the same or a different valley and a locking position, thereby recoupling the locking means to the adjustment member.

In a preferred embodiment, the outer fin surfaces adjacent to the base are flared. It is preferable that these flared sides contact the external bottom surface of a surfboard to which the adjustable fin is mounted to reduce any drag or other effect from the almost right angled corner usually created between most fins known in the art and the surfboard on which it is mounted.

In another preferred embodiment, the fin section comprises a ridge protruding from at least one outer fin surface, and preferably a substantially matching ridge on either outer fin surface, the ridge substantially parallel to the external bottom surface of the surfboard on to which the fin is mounted. The ridge preferably comprises flared or curved sides and even more preferably, the knob of the locking means is substantially aligned with the ridge when the locking means is coupled to the adjustment member. In addition, a portion of the ridge is shaped to prevent the knob from being turned more than 180 degrees, and more preferably 90 degrees. A benefit of incorporating the shape of the locking means into the ridge is to enable a user easy access to the locking means extending from the outer fin surface while reducing drag which would otherwise be caused by the locking means if it extended from an outer fin surface without such a ridge.

A further preferred embodiment provides an independent bottom portion of an adjustable fin of the invention as herein described, to which an upper portion of the fin section is attachable at an upper fin portion attachment surface. Preferably, the bottom portion of the adjustable fin comprises the locking means and the internal cavity. The upper fin portion attachment surface preferably comprises an upper fin portion attachment means for attaching the upper portion of the fin section to the bottom portion of the adjustable fin.

The upper fin portion attachment means in one embodiment comprises at least one biscuit joint for attaching the bottom portion of the adjustable fin to the upper portion of the fin section. At least a portion of the joinery 'biscuit' is preferably incorporated into the form of the bottom portion of the adjustable fin of the invention. The upper portion of the fin section may be attached to the biscuit joint with screws or rivets, or may be formed over the biscuit joint in a mold.

A benefit of a separate bottom portion of the adjustable fin of the invention is for manufacturing purposes wherein the same bottom portion of the adjustable fin of the invention can be formed into a wide variety of different complete fins by attaching an equally wide variety of upper fin portions of, for example, amongst others, different shapes, sizes, templates, and of different materials. The upper portion of the fin section may comprise at least one part. In one, non-limiting example, the upper fin portion may comprise three parts including two upper portion outer fin surfaces, and an internal honeycomb structure to produce rigidity and strength while reducing weight.

In another embodiment, the upper fin portion attachment means comprises one or more surfboard fin plugs and/or fin boxes forming a cavity or cavities in the upper fin portion attachment surface. In one, non-limiting example, the one or more surfboard fin plugs and/or fin boxes are preferably compatible with, and capable of attaching to commercially available fin mounting blocks including commercially available FCS® fin and/or Futures® fin mounting blocks. In one non-limiting example, a commercially available FCS® fin, preferably a quad fin which is shorter than a thruster fin, with the FCS® dual mounting blocks could comprise the upper fin portion and be attached to a bottom portion of the adjustable fin of the invention to complete the adjustable fin of the invention. Two screws, for example, amongst others, hex or 'Grubscrews' could be used to secure the, for example, FCS® quad fin to the bottom portion of the adjustable fin of the invention, accessed through screw holes in the bottom portion of the fin section.

In a further embodiment, the upper fin portion attachment means comprises one or more cavities for accommodating tabs on the upper fin portions. Adhesive is preferably used to attach the tabs within the cavities. In one example, five cavities in the upper fin portion attachment surface accommodate five asymmetrically shaped tabs.

The attachment of the upper portion of the fin section to the bottom portion of the adjustable fin completes the adjustable fin for use on a surfboard. Thus, the invention further provides manufacture of an adjustable fin as described herein comprising attaching the bottom portion of the adjustable fin to the upper portion of the fin section.

Second Aspect of the Invention

The first aspect of the adjustable fin of the invention comprises a slidable joint for coupling the base to the fin section, wherein the fin section comprises at least a portion of the tongue of the joint, and the base comprises at least a portion of the groove of the joint. Alternatively, according to a second aspect of the adjustable fin of the invention, the fin section comprises at least a portion of the groove, and the base comprises at least a portion of the tongue, of a sliding joint for coupling the base to the fin section.

According to the second aspect of the adjustable fin of the invention, the fin section comprises at least a wall and a portion of the base of the groove on opposing sides or either side of the internal cavity, and the adjustment member comprises at least a wall and a portion of the base of the tongue of a sliding joint. The sliding joint preferably comprises a sliding dovetail joint, and the fin section comprises at least a wall and a portion of the base of a sliding dovetail groove on opposing sides of the internal cavity, and the adjustment member comprises at least a wall and a portion of the base of the dovetail tongue either side of the adjustment member. The fin section preferably comprises at least a wall of the groove on opposing sides of the internal cavity. More preferably, the fin section comprises at least a wall and a portion of the base of the groove on opposing sides of the internal cavity, and the base comprises at least a wall and a portion of the base of the tongue of a sliding joint.

In a preferred embodiment, the sliding joint preferably comprises a sliding dovetail joint, and the fin section comprises at least a wall and a portion of the base of a sliding dovetail groove on opposing sides, that is, either side, of the internal cavity, and the adjustment member comprises at least a wall and a portion of the base of the dovetail tongue either side of the adjustment member. More preferably, the fin section comprises at least a wall of a sliding dovetail groove and a portion of the base of the dovetail groove adjacent to the wall, on opposing sides of the internal cavity, and the base comprises at least the cheeks of a dovetail tongue.

The base according to the second aspect of the adjustable fin of the invention may comprise a mounting means as described herein.

However, in a preferred embodiment according to the second aspect of the adjustable fin of the invention, the mounting means comprises:

- a base attachment plate comprising a substantially flat base attachment surface which contacts the external bottom surface of a surfboard on to which it is mounted.

The base attachment plate is preferably attached to the external bottom surface of the surfboard with adhesive and/or screw type fasteners including screws.

In this respect, the base attachment surface preferably comprises at least one cavity in the substantially flat surface. More preferably, the at least one cavity can be filled with an adhesive for attaching the base attachment surface to the external bottom surface of a surfboard. The base attachment plate comprises at least one conduit which passes through the base attachment plate and one end of the conduit opens into a cavity.

The adhesive is preferably introduced into a cavity through a conduit. More preferably, adhesive is injected through a conduit into a cavity and a second conduit with an end also opening into the cavity enables air in the cavity to escape to avoid the formation of air bubbles which could prevent the complete filling of a cavity with adhesive.

Before or after the adhesive has set or 'cured' in a cavity, the conduits may be used as screw holes when attaching the base attachment plate to the external bottom surface of the surfboard with screw type fasteners, for example, screws, or rovings. Thus, in a preferred embodiment, the base attachment plate is attached to the external bottom surface of the surfboard with both adhesive and screws.

In a second preferred embodiment of the base according to second aspect of the invention, the base attachment plate and adjustment member comprise separate components of a base assembly. In a preferred embodiment, the base attachment plate is pivotably engaged with the adjustment member, wherein:

- the base attachment plate comprises a half or semi cylindrical rod shaped projection extending in a direction substantially contrary to the base attachment surface; and
- the adjustment member comprises a saddle, the saddle comprising a portion of a cylindrical shell extending at least a portion of the length of the adjustment member which can pivotably engage with the semi cylindrical rod shaped projection.

The saddle can be secured to the semi cylindrical rod shaped projection, and preferably, the saddle is secured to the semi cylindrical rod shaped projection with screw type fasteners, for example, screws. Securing the saddle of the adjustment member to the semi cylindrical rod shaped projection sets the angle of the adjustment member relative to the base attachment plate. This angle may be selected by a surfboard shaper setting an angle for a desired surfboard fin cant when the adjustable fin is mounted to a surfboard.

After the saddle of the adjustment member is secured to the semi cylindrical rod shaped projection at a selected angle, a base cover plate is preferably secured to at least the base attachment plate and/or a portion of the adjustment member, wherein the base cover plate covers at least the outer surface of the base attachment plate that does not comprise the base attachment surface, and covers the saddle of the adjustment member. Preferably, the base cover plate comprises a hole through which the adjustment member can extend through, and through which the adjustment member passes when placing the base cover plate onto the base attachment plate. Screws can be passed through the base cover plate and base attachment plate to secure together the base assembly.

Alternatively, the saddle of the adjustment member may be additionally secured to the rod shaped projection at a selected angle, for example, with screws. The selected angle, for example, amongst others, is approximately 3.5 degrees off 90 degrees, wherein 90 degrees is measured between the adjustment member and the surface of the base attachment surface.

Securing the base cover plate onto the base attachment plate completes assembly of the base according to the second aspect of the invention. The fin section can then be coupled and secured to the base as described herein to complete the adjustable fin of the invention.

The front profile of the fin section according to the second aspect of the adjustable fin of the invention is preferably rounded, 'bulbous', or 'submarine-shaped' towards the bottom of the fin section adjacent to the mounting means. This shape is possible due to the configuration of the components of the sliding joint according to the second aspect. The benefit of this shape is that it allows a variety of different cants for the fin section relative to the surfboard on to which it is mounted, which is not possible when the adjustable fin according to the first aspect comprises flared surfaces adjacent the mounting means.

The fin section according to the second aspect may also comprise other cut-outs which are necessary in the production of the fin section. Such cut-outs may allow water to pass through into the internal cavity, or the cut-outs may be filled with material, for example, flexible polymer or polycarbonate, amongst other materials.

Third Aspect of the Invention

According to a third aspect, the invention provides a dual fin comprising a fin section, a second fin section and a base, the base comprising a mounting means for attaching the dual fin to a surfboard.

In preferred embodiments of the third aspect of the invention, a second fin section is attached to a fin section according to either the first aspect of the adjustable fin of the invention or the second aspect of the adjustable fin of the invention, the second fin section comprising two outer fin surfaces which meet at a leading edge and a trailing edge, and an underside surface meeting both outer fin surfaces.

The second fin section is preferably attached to the fin section by one or more attachment means. Attachment means may, in some non-limiting examples, comprise rods, plates, pins, bars, and/or be formed from a portion of either the fin section or the second fin section. More preferably, the one or more attachment means comprise one or more ribs, and even more preferably, three ribs. The one or more attachment means preferably preserve a minimum distance between the fin section and the second fin section of between approximately 0.1 mm and 5 mm. The one or more attachment means preferably preserve a minimum distance between the fin section and the second fin section of between approximately 0.25 mm and 1.5 mm. The one or more attachment means more preferably preserve a minimum distance between the fin section and the second fin section of approximately 1 mm. The attachment means preferably reduce or remove any 'fluttering' effect on either fin section caused by water passing around and between the fin section and the second fin section.

The second fin section is preferably positioned substantially parallel to the fin section and offset such that the leading edge of the second fin section is not aligned with the leading edge of the fin section. Alternatively, the leading edges of the fin section and the second fin section may be substantially aligned. The fin section preferably comprises a flat foil having a substantially flat outer fin surface, and a curved outer fin surface. The second fin section also preferably comprises a flat foil having a substantially flat outer fin surface, and a curved outer fin surface. In a preferred embodiment, the substantially flat outer fin surface of the fin section and substantially flat outer fin surface of the second fin section substantially face the same direction, and the leading edge of the fin section is in a position forward of the leading edge of the second fin section. Preferably, the leading edge of the fin section is forward of the leading edge of the second fin section by approximately 5 mm to 25 mm, and more preferably by approximately 10 mm.

The second fin section preferably comprises at least one passage through which water can pass. The passage comprises an opening on each outer fin surface of the second fin section through which water can enter and exit. The passage preferably comprises an opening on the substantially flat outer fin surface, and an opening on the curved outer fin surface, and the opening on the curved outer fin surface is located between the trailing edge of the second fin section and the minimum distance between the fin section and the second fin section. Preferably, the opening of the passage on the substantially flat outer fin surface of the second fin section is located closer to the leading edge of the second fin section than the opening of the passage on the curved outer fin surface of the second fin section. This will mean that when in normal use on a surfboard, water will preferentially enter the opening on the substantially flat outer fin surface, pass through the passage, and exit through the opening on the curved outer fin surface. A passage and an opening to a passage through the second fin section is preferably not round or another shape that would cause water passing through the passage to form a vortex. The openings and passages may be created from drilling or cutting holes or perforations through the second fin section or from the shape of a mold used to make the fin section.

An adjustable dual fin according to the third aspect of the invention is preferably mounted in the position of a side fin on a surfboard wherein:

- at least the second fin section comprises a flat foil having a substantially flat outer fin surface facing the centre line or stringer of the surfboard, and a curved outer fin surface facing the adjacent rail of the surfboard;
- the fin section is in a position closer to the adjacent rail of the surfboard than the second fin section; and
- the leading edge of the fin section is positioned closer to the front of the board than the leading edge of the second fin section.

Two or more adjustable dual fins according to the third aspect of the invention may be mounted to a surfboard.

In a preferred embodiment, the second fin section comprises at least one passage comprising an opening on the substantially flat outer fin surface, and an opening on the curved outer fin surface of the second fin section through which water can pass. When the adjustable dual fin of the third aspect of the invention is mounted to a surfboard which is moving in a substantially forward direction through water during normal use, the at least one passage in the second fin section is preferably configured to:

enable water to enter an opening on the substantially flat outer fin surface of the second fin section, pass through the passage, and exit through an opening on the curved outer fin surface in a location between the trailing edge of the second fin section and the position of the minimum distance between the fin section and the second fin section; and substantially prevent water passing in the reverse direction through the passage.

The openings preferably comprise holes or perforations on the surface of the substantially flat and curved outer fin surfaces of the second fin section through which water can enter and exit, respectively. Preferably, the opening on the substantially flat outer fin surface of the second fin section is positioned closer to the leading edge than the opening on the curved outer fin surface.

In an alternative embodiment of the third aspect of the adjustable dual fin of the invention, both the fin section and the second fin section are attached to the base. The fin section may be an adjustable fin according to either the first aspect or second aspect of the invention. The second fin section may be an adjustable fin according to either the first aspect or second aspect of the invention.

The second fin section may be the same size or a different size to the fin section. The second fin section may have a different fin template to the fin section. Preferably, the size and template of the second fin section is similar or the same as the size and template of the fin section.

Portions of the fin section and/or the second fin section preferably comprise a titanium alloy as described herein. The remainder of the fin section and/or the second fin section is preferably an overmolding, for example, a flexible polymer overmolding.

Without wanting to be limited by any one theory, it is believed that the adjustable dual fin according to the third aspect of the invention provides a benefit of increased thrust and therefore speeds in a direction substantially towards the front of a surfboard it is mounted to when in normal use, for the following reasons.

The distance between the flat outer fin surface of the fin section and the curved outer fin surface of the second fin section is nearest at the peak of the curved outer fin surface of the second fin section. This distance is preferably between approximately 0.1 mm and 5 mm, more preferably between approximately 0.25 mm and 1.5 mm, and even more preferably approximately 1 mm. The proximity and position of the fin section and the second fin section forms a V-shaped channel between the peak and the leading edge of the fin section and the leading edge of the second fin section, the V-shaped channel extending along the curved length of the fin sections to their tips. On the other side of the peak is a rear chamber formed between the peak and the trailing edge of the fin section and the trailing edge of the second fin section.

During normal use when mounted on a surfboard, water passes into the V-shaped channel but only a small amount of this water can pass between the thin gap between the fin section and the second fin section. The majority of the water is forced along the length of the V-shaped channel towards the tip of the fin sections at a higher velocity than the normal speed that water is passing the fin sections. This higher velocity is generated due to the higher pressure behind the water forced into the channel than the pressure of the water in front of the water leaving the channel adjacent to the tips of the fin sections according to Newton's 2nd law. In accordance with Bernoulli's principle, the increase in the velocity of the water occurs simultaneously with a decrease in pressure. Therefore, a region of low pressure is created in this V-shaped channel.

Conversely, some water passes through the thin gap between the fin section and the second fin section, and passages direct water through the second fin section from the side of the substantially flat outer fin surface into the rear chamber. The effect of forcing all of this water into the limited space of the rear chamber results in the creation of a region of high pressure.

The pressure differential between the area of low pressure in the V-shaped channel and the area of high pressure in the rear chamber results in a lift force acting perpendicular to the direction of the fluid flow in the V-shaped channel. That is, in a direction towards the front of the fin on a slight downward angle. The thrust provided by this lift force acts to increase the overall speed of the fins in this direction, and therefore, the board through the water.

The adjustable dual fin according to the third aspect comprises a mounting means as herein described. If the dual fin comprises a fin section according to the second aspect of the invention and the mounting means comprises a base attachment plate, the cant of the dual fin may be set off 'centre' (90 degrees), for example at approximately 3.5 degrees off centre.

Locking Screws

In a preferred embodiment, the adjustable fin of the invention according to any of the herein described aspects, further comprises locking screws that can be housed in screw holes in the fin section and can be screwed into the internal cavity to contact the adjustment member and provide further means of coupling the fin section to the base.

The locking screws may comprise, for example, amongst others, socket screws (may also be referred to as Allen screws or Grubscrews) having a hexagonal socket in the head which require an Allen key or hex key to tighten or loosen them. In another preferred example, the locking screws comprise a slot and may be turned using an object placed in the slot and turned by a user. A coin such as an American dime and Australian 10 cent piece can preferably be used to turn the locking screws. The screws may be turned by other means known in the art including foldable wing nut-type screws wherein the wing nut can be unfolded to turn the screw and then refolded.

The locking screws may be screwed into the adjustment member or another part of the base which may or may not comprise indents, cavities or holes for the locking screws to be screwed into to contact with the base and provide an additional means of securing the adjusted fin section to the base of an adjustable fin of the invention. Preferably, two locking screws are located either side of the fin section.

The locking screws can be beneficial where the adjustable fin of the invention is used on, for example, kite boards, wake boards, wind surfers, big wave surfboards, and other such boards where the adjustable fins will be exposed to considerably greater forces than those faced during regular shortboard surfing and aim to prevent or minimise fin 'wobble'.

Alternatively, one or more locking screws may be used with the adjustable fin of the invention as the locking means to couple and uncouple the base to the fin section to enable slidable movement of the fin section relative to the base.

Safety

For the purpose of maintaining the safety of users of one or more adjustable fins of the invention on a surfboard, the adjustment member preferably comprises a weak portion.

The weak portion comprises a portion of the adjustment member that can more easily be broken than the remaining portion of the adjustment member. More preferably, the weak portion is adjacent to the mounting means. Under strong forces acting on an adjustable fin of the invention, for example, heavy contact of: a reef, the surfer, another surfer, another board, or rocks, amongst others, the adjustment member can break at the weak portion. The purpose of the breakage is to reduce the potential damage to the person the adjustable fin comes into contact with, or reduce or minimise damage to the board to which the fin is mounted which can occur if a fin gets torn out of the board due to catching on a reef or rock, as some non-limiting examples.

The weak portion may comprise a portion of the adjustment member that is thinner than the preferably 1 mm to 2 mm thickness of other portions of the adjustment member. In another embodiment, the weak portion may comprise perforations in a line that is substantially parallel to the mounting means and teeth.

A further safety feature is the overmolding of flexible polymer over titanium alloy fin portions, when used, to prevent sharp leading and tailing edges from being a danger to the surfer or other nearby persons in the water.

Mounting Means

The mounting means for an adjustable fin of the invention as herein described may comprise a variety of means known for mounting or attaching a fin to a surfboard or another board.

In a preferred embodiment of an adjustable fin of the invention according to the first, second, or third aspect described herein, the mounting means comprises one or more mounting blocks for attaching to one or more surfboard fin plugs and/or fin boxes. The one or more mounting blocks are preferably compatible with, and capable of attaching to commercially available fin plug and/or fin box systems. Preferably, the one or more mounting blocks can be mounted to commercially available FCS® fin plugs and/or Futures® fin boxes.

In another preferred embodiment, the mounting means comprises a base attachment surface which is directly and fixedly secured to the external bottom surface of the surfboard with adhesive and/or screw type fasteners as described herein. The adhesive is preferably Araldite®, marine silicon, or another epoxy or non-latex construction silicone adhesive that can maintain an adhesive connection between an adjustable fin of the invention and a surfboard or another board, particularly when exposed to water. The marine silicon may provide up to, or greater than 600% elongation ability thereby providing a bond between the adjustable fin of the invention and a surfboard on to which it is mounted, which will unlikely break even under the forces of a heavy surfer turning sharply and quickly on a heavy wave. The base attachment surface preferably provides recesses of a size sufficient to accommodate the adhesive to provide such a bond between the adjustable fin and the surfboard.

Preferably, one or more screws or screw type fasteners secure a base attachment plate comprising at the base attachment surface to the surfboard and preferably in combination with adhesive. The one or more screws may be secured to the surfboard at a variety of different positions through the base attachment plate. Preferably, the screws are placed at least in front of the leading edge of the adjustable fin, behind the trailing edge, and adjacent to each outer fin surface. The screws may be secured to the surfboard through holes in the base attachment plate through which adhesive is injected. The screws can preferably be turned with a hex or Allen key and screw plugs, for example, plastic screw plugs, may be pre-set in the surfboard into which the screws can be driven and embedded to secure the base of the adjustable fin to the surfboard.

In another embodiment, the base attachment surface may be 'fiberglassed' onto the surfboard using traditional 'glassing' methods known in the art. For example, comprising placing 'rovings' around the outer edge or border of the base attachment surface.

Adjustment Indicators

Means for showing the user the position of the fin section relative to the base are also within the scope of the invention. Such means may include adjustment indicators, markings or numbering on the fin section, cut-outs of the fin section, 'windows' or transparent portions of the fin section, or a combination of these, as some non-limiting examples. These means would, for example, enable a user to determine whether two or more adjustable fins mounted as side fins on a board have been adjusted equally. In another example, a user could identify by these means the position of a fin section relative to its base when an adjustable fin of the invention is mounted to a board, without having to manipulate or even touch the adjustable fin.

Elevated Fin Section

In preferred embodiments of the adjustable fin of the invention as herein described, a portion of the fin section, preferably adjacent to the opening to the internal cavity, contacts, abuts or aligns flush to the external bottom surface of the surfboard on to which the adjustable fin is mounted.

In an alternative embodiment of the adjustable fin of the invention according to an aspect as herein described, the adjustable fin comprises an extended base which forms a gap between the fin section and the external outer surface of a surfboard on to which it is mounted. The length of the gap between the fin section and the external outer surface of the surfboard is preferably between approximately 5 mm and 25 mm. The length of the gap is more preferably approximately between approximately 10 mm and 20 mm. The length of the gap is more preferably approximately 15 mm. Without wanting to be limited by any one theory, a benefit of elevating a fin section from the outer surface of a surfboard on which it is mounted is to reduce drag, when compared to a fin section which abuts or aligns flush with the outer surface of a surfboard.

Board Type

The adjustable fin of the invention according to an aspect as herein described may be mounted to any one of the boards in the group comprising: surfboard, shortboard, kneeboard, longboard, minimal, soft board, kiteboard or a board used for kite surfing, wind surfer, stand up paddleboard, wakeboard, rescue board, bodyboard, or another board used in surface water sports or activities. Reference herein to a surfboard can also include reference to any one of these other boards.

Fin Arrangement

More than one adjustable fin of the invention according to an aspect or embodiment as described herein may be mounted to a surfboard. For example, a thruster fin setup on a surfboard may comprise up to three adjustable fins of the invention as described herein. Alternatively, a single fin or a quad fin setup comprising adjustable fins of the invention may be mounted on to a surfboard. In some non-limiting examples, a fin arrangement may comprise:

Three adjustable fins according to the first or second aspect of the invention and the three adjustable fins are in a 'thruster' arrangement;

Two adjustable side fins at a 3.5 degree cant according to the second aspect of the invention and a centre fin according to the first aspect of the invention; or Two adjustable dual side fins according to the third aspect of the invention and a centre fin according to the first or second aspect of the invention Various combinations are therefore possible for using various embodiments and/or aspects of adjustable fins of the invention as described herein, exclusively, or in combination with non-adjustable or other types of fins on a surfboard.

Process for Mounting a Fin of the Invention

The present invention further provides a process of mounting an adjustable fin of the invention as herein described, to any one of the boards in the group comprising: surfboard, shortboard, kneeboard, longboard, minimal, soft board, kiteboard, wind surfer, stand up paddleboard, wakeboard, rescue board, bodyboard, or another board used in surface water sports or activities. The present invention also provides a process of mounting an adjustable fin of the invention to a surfboard by mounting the adjustable fin using a mounting means as described herein.

Process for Manufacturing a Fin of the Invention

The present invention also provides a process of manufacturing an adjustable fin of the invention or a bottom portion of an adjustable fin of the invention as described herein. The adjustable fin of the invention is preferably constructed from common materials used to make surfboard fins and/or from materials described herein. In one embodiment of the invention, part or the entire base and/or bottom portion of the adjustable fin is constructed from, or comprises, a metal or a metal alloy. In another embodiment, the entire adjustable fin of the invention is made of metal. The metal is preferably strong, light weight, and incapable of rusting or significant corrosion.

In a preferred embodiment, the metal is titanium. Preferably, the metal is a titanium alloy. More preferably, the titanium alloy comprises between approximately 3.5% to 4.5% vanadium, and between approximately 5.5% to 6.75% aluminium. Most preferably, the titanium alloy comprises approximately 4% vanadium and approximately 6% aluminium. In a preferred embodiment, a portion of the fin section and any second fin section comprises a titanium alloy. This titanium alloy can provide beneficial flex characteristics for a surfboard fin constructed wholly or almost wholly from this material. The titanium alloy in the fin section preferably comprises holes or cut outs of the same or various sizes which can further reduce the weight of the fin and increase the flex characteristics of the upper fin section. The titanium or titanium alloy is preferably encased within a flexible polymer overmold by the process of overmolding. The overmolding may be molded to cover the shape of the titanium alloy fin, or may form a larger portion of a fin section which contains within it a titanium alloy fin portion.

Use of the titanium alloy in the adjustable fin of the invention enables a thinner fin to be constructed. Where a commercially available shortboard fin may be 7 mm to 8 mm thick at its thickest point on the fin section, the titanium alloy fin section is preferably between approximately 1.5 mm and 3 mm thick, and more preferably between 2 mm and 2.5 mm thick, at its widest point. With the overmolding over the titanium alloy, the fin section is preferably between approximately 2.5 mm and 4 mm thick, and more preferably between 3 mm and 3.5 mm thick at its widest point.

In another embodiment, the whole fin, part or the entire base and/or bottom portion of the adjustable fin comprises dust or flakes of: titanium, or titanium alloy comprising approximately 4% vanadium and approximately 6% aluminium.

Alternatively, the metal is aluminium. The fin section may be formed from two halves joined together or from more components.

Similarly to the large number of different fins currently available for mounting to a surfboard or another type of board described herein, an adjustable fin of the invention can comprise a variety of different: shapes or templates or even cants; outer fin surface shapes or features; sizes; types of foils; colours; materials from which the fin section is constructed; rakes; depths; widths; cants; cut-outs; and other designs and extensions including channels, 'tunnels' and 'wings', amongst others. In this regard, a user can select and mount an adjustable fin of the invention to a board with attributes that is desired by the user or suitable for the user's requirements and appropriate for the board the adjustable fin or fins are mounted on.

In developing the present invention, the inventor addressed many issues that have prevented successful uptake of adjustable fin systems by surfers and other board riders.

A first benefit is that no tools are required to adjust the position of the adjustable fin on the surfboard. This means that a surfer or another board rider can easily adjust the position of one or more adjustable fins of the invention on their board without even leaving the water. This allows the 'fine tuning' of their board to adjust to a much greater range of swell sizes and conditions without paddling in to the beach to swap fins and/or surfboards, and no need for tools or equipment.

A second benefit is that the adjustable fin of the invention can incorporate mounting blocks that attach to existing fin plug and fin box arrangements such as FCS® fin plugs or Futures® fin boxes. As a result, surfers and other board riders do not have to purchase a new board having a specific fin plug or box arrangement but can use one or more adjustable fins of the invention in their current boards, and without any modifications to their boards.

A third benefit is that one or more base of the adjustable fin of the invention can be left attached to the surfboard and the fin section removed, either for transport (for an adjustable fin of the invention according to the second aspect), or to swap different fin sections without tools as the user requires or desires.

DESCRIPTION OF PREFERRED EMBODIMENTS

Those skilled in the art will appreciate that the invention described herein is susceptible to variations and modifications other than those specifically described. It is to be understood that the invention includes all such variations and modifications. The invention also includes all of the steps, features, compositions and compounds referred to or indicated in the specification, individually or collectively and any and all combinations or any two or more of the steps or features.

The present invention is not to be limited in scope by the specific embodiments described herein, which are intended for the purpose of exemplification only. Functionally equivalent products, compositions and methods are clearly within the scope of the invention as described herein.

Throughout this specification, unless the context requires otherwise, the word "comprise", or variations such as "comprises" or "comprising", will be understood to imply the inclusion of a stated integer or group of integers but not the exclusion of any other integer or group of integers.

Other definitions for selected terms used herein may be found within the detailed description of the invention and apply throughout. Unless otherwise defined, all other scientific and technical terms used herein have the same meaning as commonly understood to one of ordinary skill in the art to which the invention belongs.

Features of the invention will now be discussed with reference to the following preferred embodiments.

First Aspect of the Invention

Figure 1:
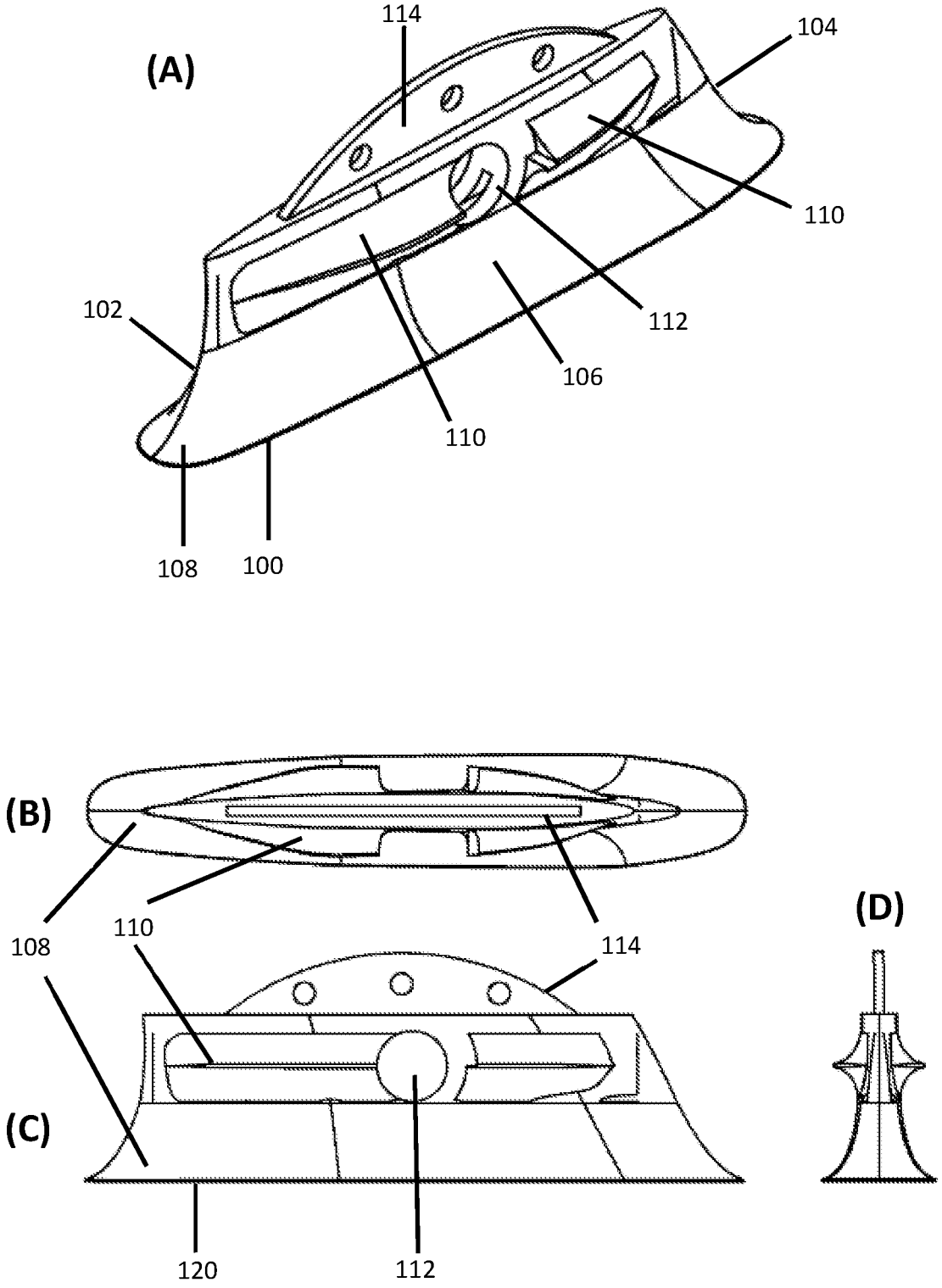
FIG. 1. are illustrations showing (A) a perspective view; (B) a top view; (C) a side view; and (D) a front view, of a preferred embodiment of a bottom portion of a fin section according to a first aspect of the adjustable fin of the invention.

A preferred embodiment of a bottom portion of the fin section according to a first aspect of an adjustable fin of the invention is shown in FIG. 1. The fin section 100 in FIG. 1A comprises a leading edge 102 and a trailing edge 104 and outer fin surfaces 106 of which only one is visible in FIG. 1A.

The outer fin surface 106 adjacent to the underside surface of the adjustable fin is flared 108. There is also a ridge 110 protruding from the outer fin surface 106 which is parallel with the underside surface 120 as shown in FIGS. 1B and 1C. At a gap between two sections of the ridge 110 is the hole 112 which accommodates the locking means which is not shown in this figure. The ridge 110 comprises flared sides.

A biscuit joint 114 shown in FIG. 1 forms an upper fin portion attachment means for attaching an upper portion of a fin section, comprising one or more parts, to the bottom portion of the adjustable fin. The biscuit joint 114 may be formed as part of the bottom portion of the adjustable fin, or attached separately, and in this embodiment comprises holes for use in attaching an upper fin portion of a fin section, or parts thereof, to complete the adjustable fin of the invention.

This allows the attachment of many different types of upper fin portions to the bottom portion of an adjustable fin of the invention to complete the adjustable fin. A key benefit of this type of construction is the bottom portion of the adjustable fin can be conserved and consistently constructed, while upper fin sections of different templates, sizes, materials, colours, and patterns can be made by the same or different manufacturers and attached to the bottom portion to form many different variations of complete adjustable fins of the invention.

Similarly to the large number of different fins currently available for mounting to a surfboard or another type of board described herein, these different variations of adjustable fins of the invention can comprise a variety of different: shapes or templates or even cants; outer fin surface shapes or features; sizes; types of foils; colours; materials from which the fin section is constructed including interior 'honeycomb' portions; rakes; depths; widths; cants; cut-outs; and other designs and extensions including channels, 'tunnels' and 'wings', amongst others. In this regard, a user can select and mount an adjustable fin of the invention to a board with attributes that is desired by the user or suitable for the user's requirements and appropriate for the board the adjustable fin or fins are mounted on.

Figure 2:
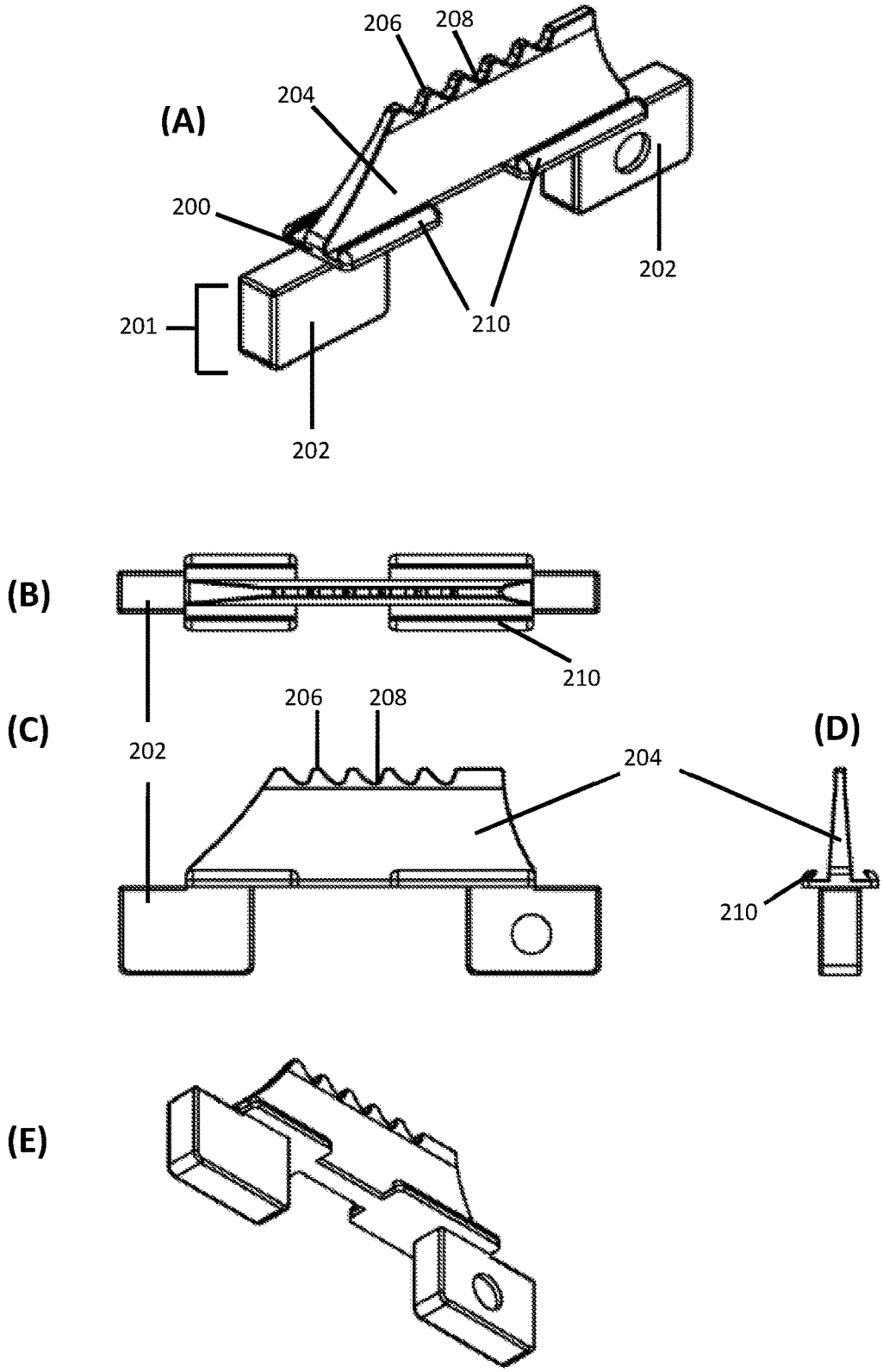
FIG. 2. are illustrations showing (A) a perspective view; (B) a top view; (C) a side view; (D) a front view; and (E) a bottom perspective view, of a preferred embodiment of a base according to a first aspect of the adjustable fin of the invention.

A preferred embodiment of the base 200 according to the first aspect of the adjustable fin of the invention is shown in FIG. 2. The base 200 comprises a mount 201 comprising two mounting blocks 202 which are compatible with the existing commercially available FCS® fin plugs fitted to a majority of existing surfboards. When the adjustable fin is mounted on to a surfboard, the mounting blocks 202 are secured within FCS® fin plugs.

The base 200 comprises a substantially planar adjustment member comprising an insert member 204 which extends in a direction contrary to that of the mounting blocks 202. At the end of the insert member 204 furthest from the mounting blocks 202 are teeth 206. Between the teeth are valleys 208.

The base 200 also comprises two sliding dovetail joint groove walls 210 and a portion of the base of the groove on either side of the insert member 204.

Figure 3:
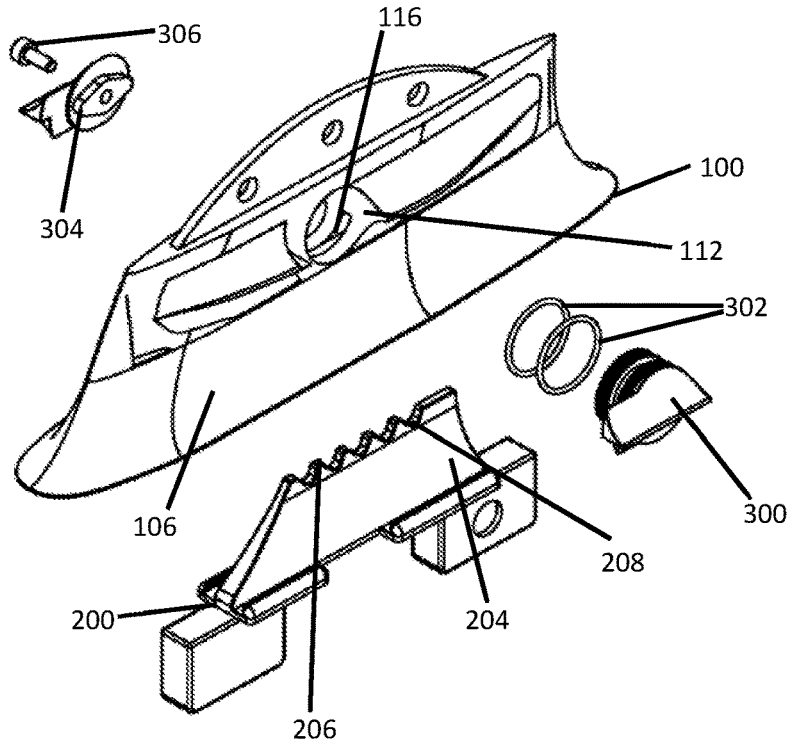
FIG. 3. are illustrations showing (A) a perspective view; (B) a top view; and (C) a front view, of an exploded complete bottom portion of a preferred embodiment of an adjustable fin of the invention according to a first aspect.
Figure 3:
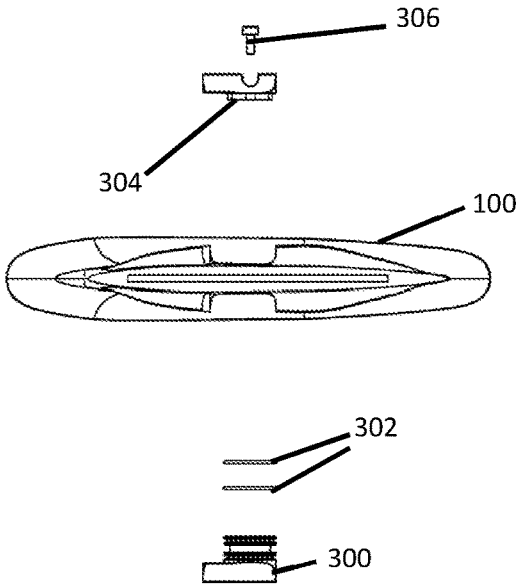
Figure 3:
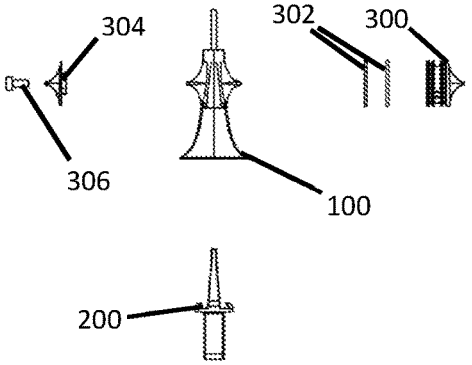

FIG. 3 shows an exploded view of the preferred embodiment of the bottom portion according to the first aspect of the adjustable fin of the invention. The substantially planar insert member 204 of the base 202 comprises teeth 206 and valleys 208, and when the base 200 is coupled with the fin section 100, these teeth 206 and valleys 208 are visible from the slot 116 where there can interact with the locking means comprising the assembly shown. The locking means comprises a knob 300 and 'O' rings 302 which enter the hole 112 from one outer fin surface 106, and a back piece 304 enters the hole 112 from the other outer fin surface 106 of the fin section 100, and a pin 306 holds the parts of the locking means together when in position in the fin section 100.

Figure 4:
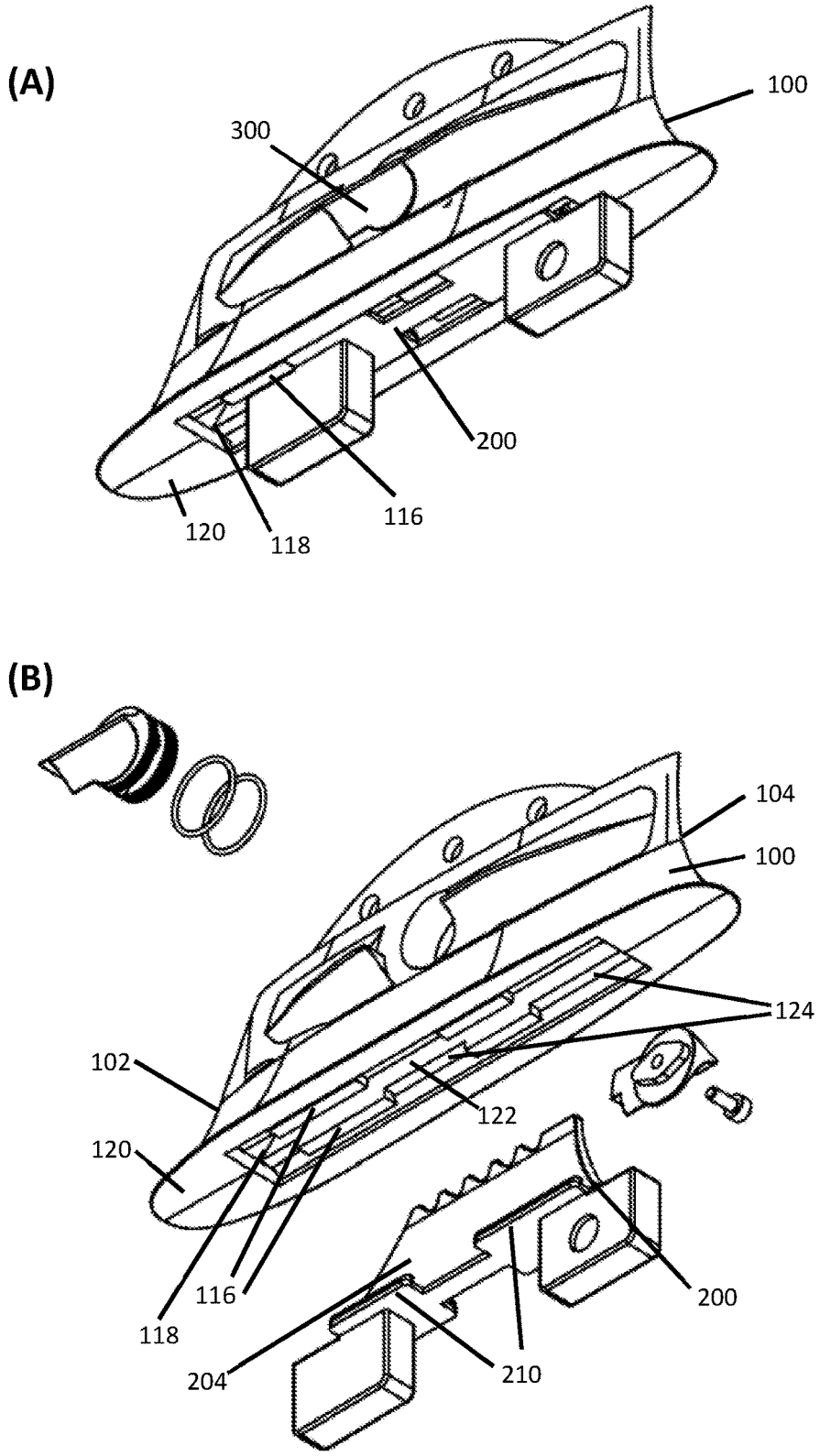
FIG. 4. are illustrations showing (A) an underside perspective view; and (B) an exploded bottom perspective view, of a preferred embodiment of a bottom portion of an adjustable fin of the invention according to a first aspect.

An assembled bottom portion of the preferred embodiment of the adjustable fin of the invention according to a first aspect is shown in FIG. 4A. An exploded view of the same bottom portion is shown in FIG. 4B. Four wedge-shaped extensions 116 project from within an indentation 118 in the underside surface 120 of the fin section 100 and the wedge-shaped extensions 116 form the cheeks of a sliding dovetail joint. The sliding dovetail joint groove walls 210 in the base 200 form a sliding dovetail joint groove. The term 'groove' has been used herein for the purposes of describing the invention. However, 'groove' may be used interchangeably with 'dado', 'slot', or 'socket', and identify the formation of a sliding groove which can accept the walls of the dovetail (also known as a 'dovetail tenon') therein coupling the base 200 to the fin section 100.

In the coupling of the base 200 with the fin section 100, the insert member 204 is inserted into the internal cavity 122 and the sliding dovetail joint groove walls 210 are directed into the indentation 118 at two gaps 124 between the wedge-shaped extensions 116, the gaps 124 of a size to allow the sliding dovetail joint groove walls 210 to pass through. Preceding or following this step, the knob 300 of the locking means is manually turned clockwise 90 degrees by a user to prevent the locking portion which comprises a non-circular (preferably 'wedge-shaped') cam from restricting movement of the teeth 206 and therefore the insert member 204 through the internal cavity 122. The base 200 is then slidably moved in a direction towards the leading edge 102 of the fin section 100 so that the wedge-shaped extensions 116 pass between and slidably engage with the sliding dovetail joint groove walls 210 therein coupling the base 200 with the fin section 100. The knob 300 is turned anti-clockwise 90 degrees when the locking portion is aligned with a valley 208 so that the locking portion enters the valley and prevents sliding movement of the fin section 100 relative to the base 200. The base 200 is now securely engaged to the fin section 100.

When the base 200 is coupled to the fin section 100, the process of adjusting the fin section 100 relative to the base 200 comprises a user turning the knob 300 90 degrees in a clockwise direction with their fingers which removes the locking portion from the valley it was located in, i.e. the first locking position. The user can then slide the fin section 100 relative to the base 200 towards the leading edge 102 or the trailing edge 104. When the locking portion is aligned with a second valley, the knob 300 can be turned 90 degrees in an anti-clockwise direction by the user, thereby moving the locking portion into the valley, i.e. the second locking position, and restraining further slidable movement of the fin section 100 relative to the base 200.

The benefit of the indentation 118 is so that once the base 200 is coupled with the fin section 100, the underside surface 120 will be in contact with the external bottom surface of the surfboard on which it is mounted.

Figure 5:
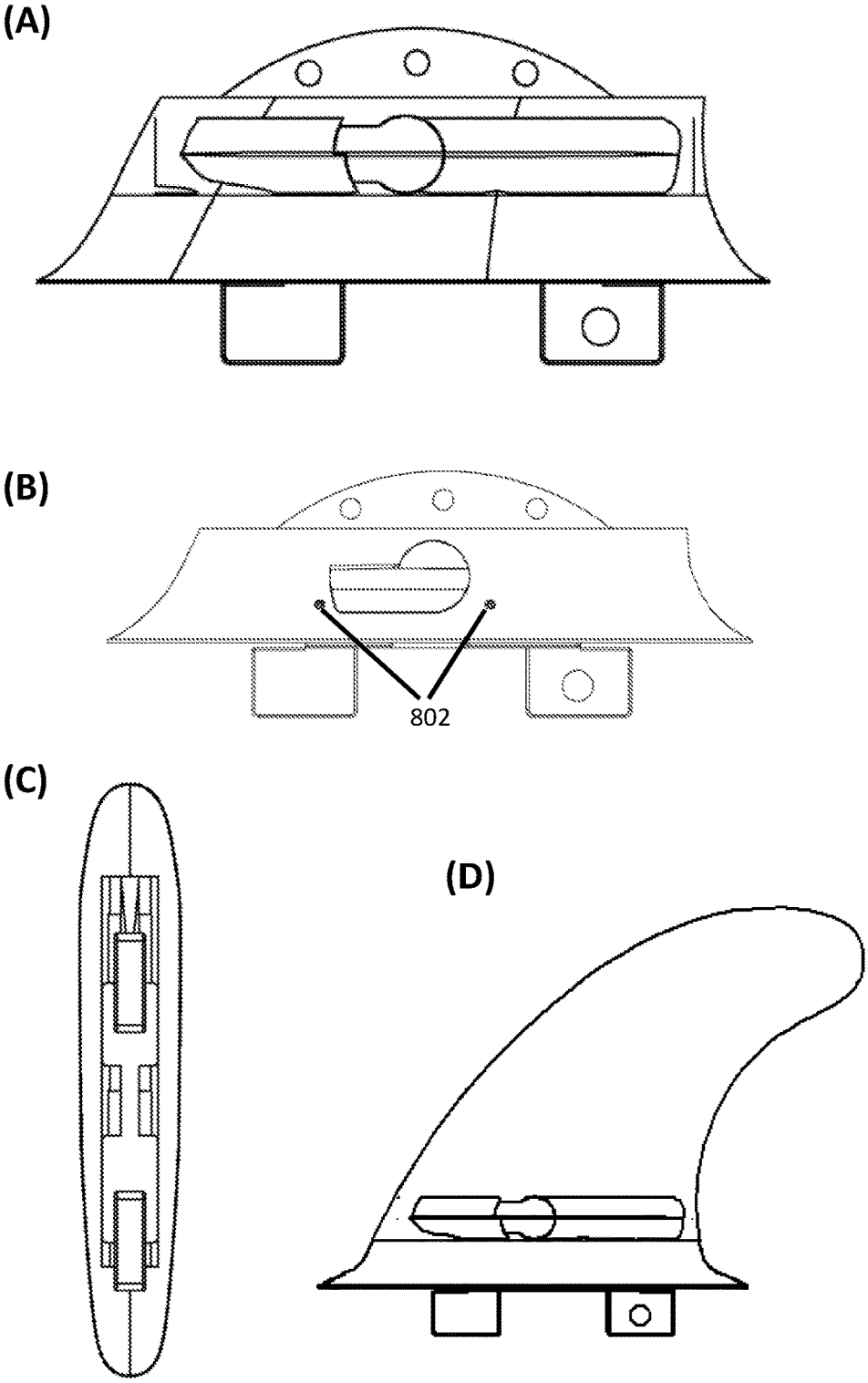
FIG. 5. are illustrations showing (A) a side view, (B) a side view showing locking screws, and (C) a bottom view, of a preferred embodiment of a bottom portion of an adjustable fin of the invention according to a first aspect; and a side view (D) of a preferred embodiment of a complete adjustable fin of the invention according to a first aspect.

FIG. 5 shows a side view (FIG. 5A), a side view showing locking screws 802 (FIG. 5B), and a bottom view (FIG. 5C) of the embodiment of the bottom portion of the adjustable fin of the invention. FIG. 5C shows an embodiment of a side view of a complete adjustable fin of the invention.

Second Aspect of the Invention

Figure 6:
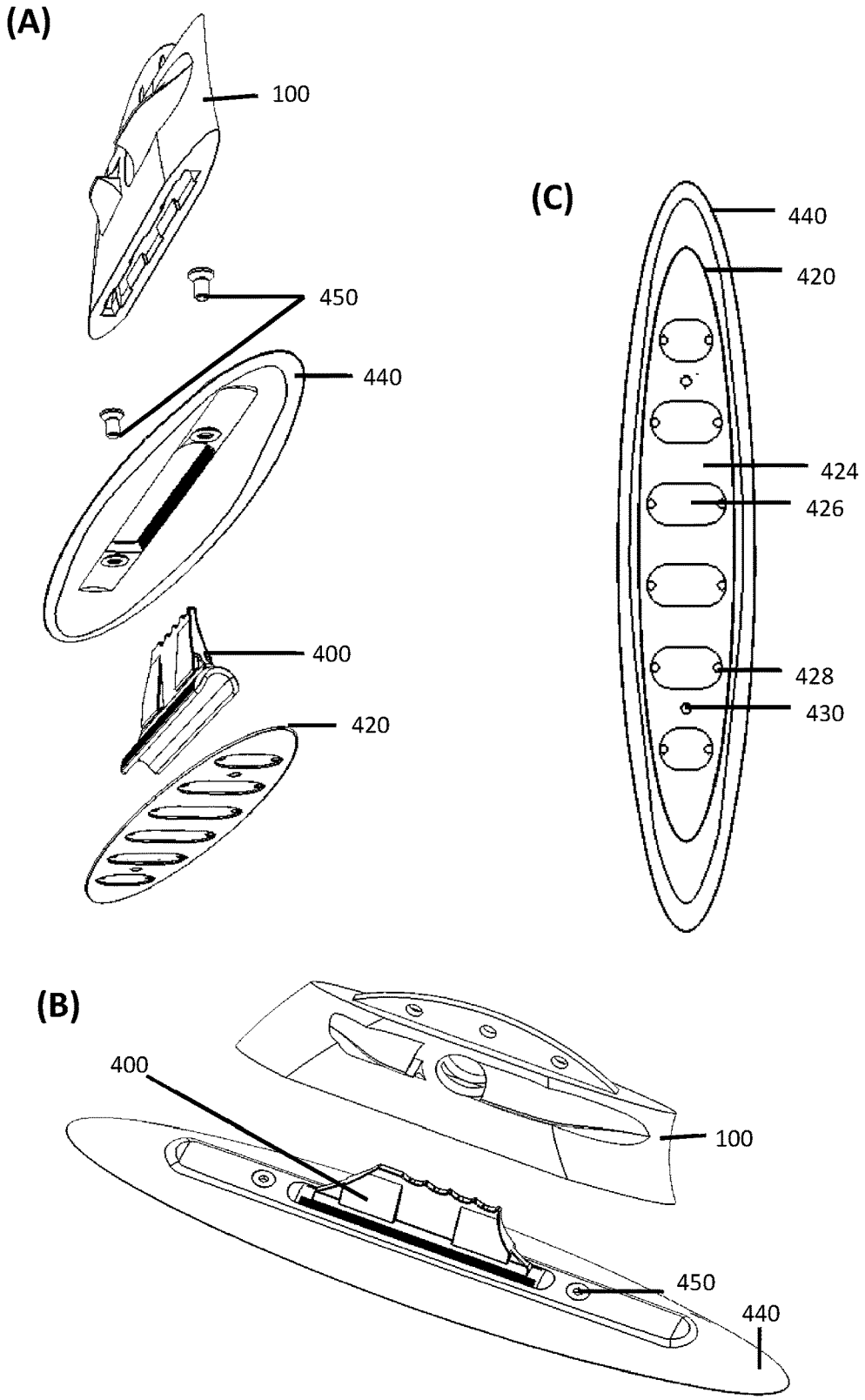
FIG. 6. is an illustration showing (A) an exploded bottom perspective view; (B) a partially exploded perspective view from above; and (C) a bottom view, of a fin section of a preferred embodiment according to the second aspect of the adjustable fin of the invention.

FIG. 6 shows an (A) exploded view, and a (B) partially exploded view of a preferred embodiment of a bottom portion of an adjustable fin of the invention according to a second aspect.

Figure 7:
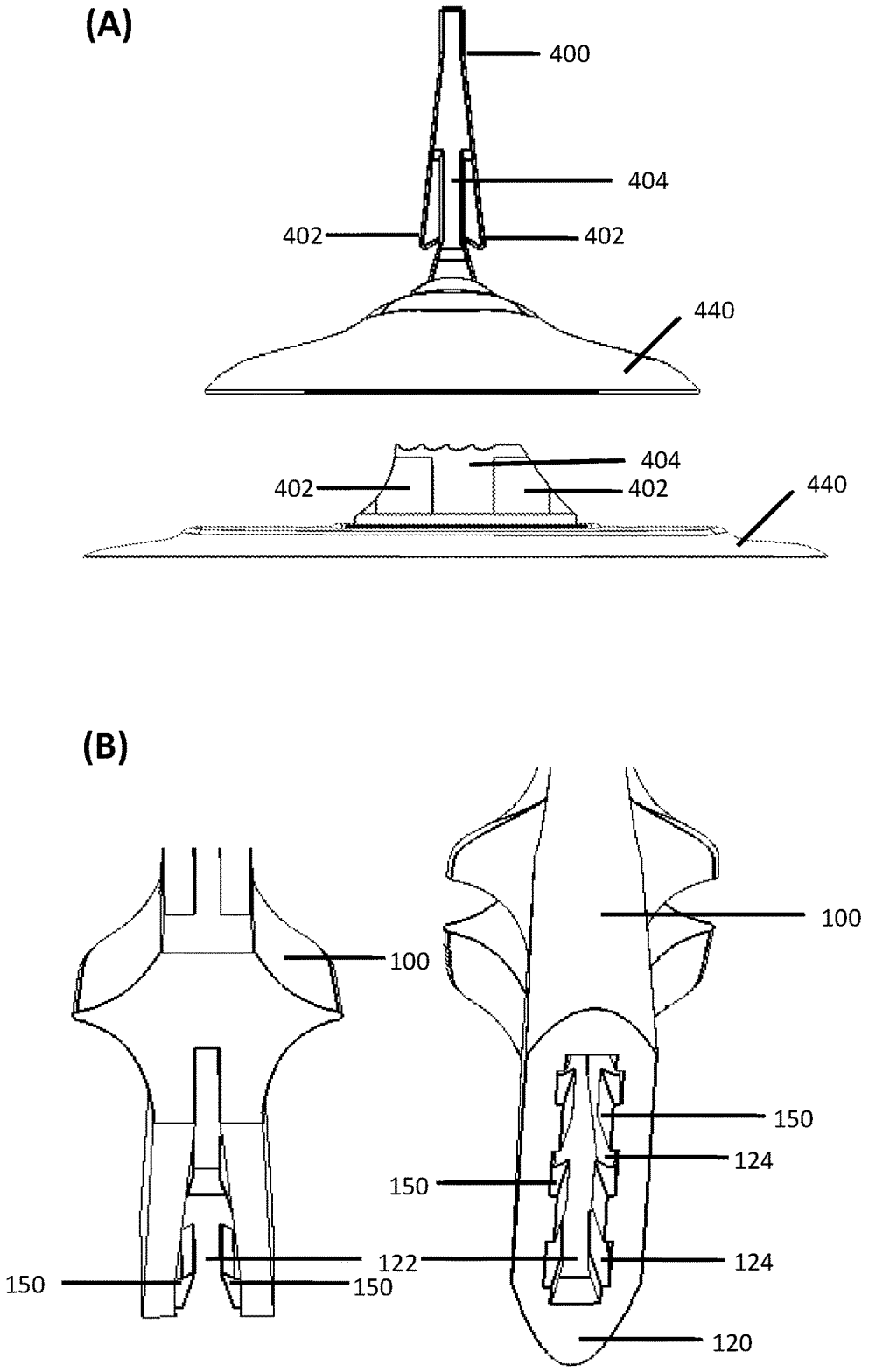
FIG. 7. is an illustration showing (A) a front and side view of a base assembly; and (B) a cross-sectional front view and an bottom perspective view of a fin section of a preferred embodiment according to the second aspect of the adjustable fin of the invention.

The bottom portion of the fin section 100 is consistent with the bottom portion of the fin section of the herein described preferred embodiment according to the first aspect of the adjustable fin of the invention, with a key difference. This difference is in relation to the position and form of the parts of the dovetail-type sliding joint for coupling the fin section to the base. In the preferred embodiment according to the first aspect of the adjustable fin of the invention, the base comprises sliding dovetail joint groove walls which can slidably engage to couple with the wedge-shaped extensions on the fin section the dovetail joint is formed from. In the preferred embodiment according to the second aspect of the adjustable fin of the invention, and as shown in FIG. 7A, the base 400 comprises wedge-shaped extensions 402 from the insert member; and the fin section 100 shown in FIG. 7B comprises sliding dovetail joint groove corners 150 located in the internal cavity 122. A sliding dovetail joint groove corner 150 comprises a sliding dovetail groove wall and a portion of the groove floor adjacent to the wall. As a result of this arrangement, for this embodiment no indentation is required in the underside surface 120 of the fin section 100.

To couple and securely engage the base 400 to the fin section 100, similarly to the hereinbefore described preferred embodiment according to the first aspect of the adjustable fin of the invention, the insert member 404 of the base 400 is inserted in the internal cavity 122 of the fin section 100 with the wedge-shaped extensions 402 aligned with the gaps 124 so they have unobstructed passage either side of the sliding dovetail joint groove corners 150. Preceding or following this step, the knob of the locking means is manually turned clockwise 90 degrees by a user to prevent the locking portion comprising a non-circular (preferably wedge-shaped) cam from restricting movement of the teeth and therefore the insert member 404 through the internal cavity 122. The base 400 is then slidably moved in a direction towards the leading edge of the fin section 100 so that the wedge-shaped extensions 402 pass into and engage with the sliding dovetail joint groove corners 150 to couple the base 400 to the fin section 100. The knob is turned anti-clockwise 90 degrees when the locking portion is aligned with a valley so that the locking portion enters the valley and prevents sliding movement of the fin section 100 relative to the base 400. The base 400 is now securely engaged with the fin section 100.

Figure 8:
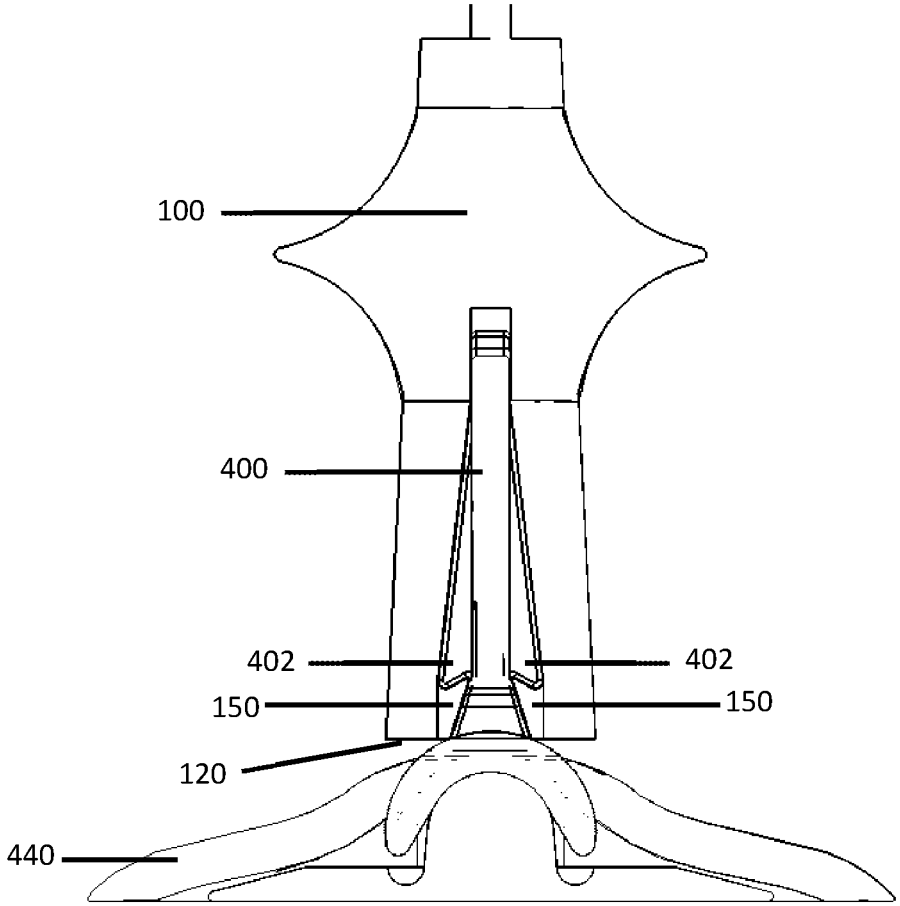
FIG. 8. is an illustration showing a cross section through an incomplete front view of a preferred embodiment according to the second aspect of the adjustable fin of the invention.

In FIG. 8, a cross-section of a fin section 100 coupled to a base 400 shows the wedge-shaped extensions 402 of the base 400 engaging with the sliding dovetail joint groove corners 150 to couple the base 400 to the fin section 100.

The base assembly of the preferred embodiment according to the second aspect of the adjustable fin of the invention comprises three components as shown in FIG. 6A: the base 400, a base attachment plate 420 comprising the mount in this embodiment, and a base cover plate 440. Screws 450 secure the base assembly together as shown in FIG. 6B.

The base attachment plate 420 comprises a substantially flat base attachment surface 424 for contacting to the external bottom surface of a surfboard to which it is to be mounted (FIG. 6C). Cavities 426 (which could also be referred to as indents) which are oval-shaped in this embodiment but may comprise a variety of different shapes are locations for adhesive which will be one means by which the adjustable fin according to this second aspect is attached to the external bottom surface of a surfboard. Preferably, the adhesive is injected into each cavity 426 through an injection conduit 428, the conduit in the form of a tunnel or injection hole, once the base attachment plate 420 is placed in the desired position on the surfboard to which it is to be mounted. A second injection conduit 428 in each cavity 426 enables air to be released from the cavity 426 as the adhesive is injected into a first injection conduit 428 and spreads throughout the cavity 426. Thus, the formation of air bubbles and therefore weaknesses in the adhesive attachment can be avoided. Once the cavity 426 is full of adhesive, excess adhesive will exit the second injection conduit 428 indicating that the cavity 426 is full, and the excess adhesive can be wiped away before it dries. Preferably, screws are driven through injection conduits 428 and into the surfboard prior to, or after the adhesive has dried, to provide additional strength in the attachment of adjustable fin to the surfboard to which it is mounted.

Figure 9:
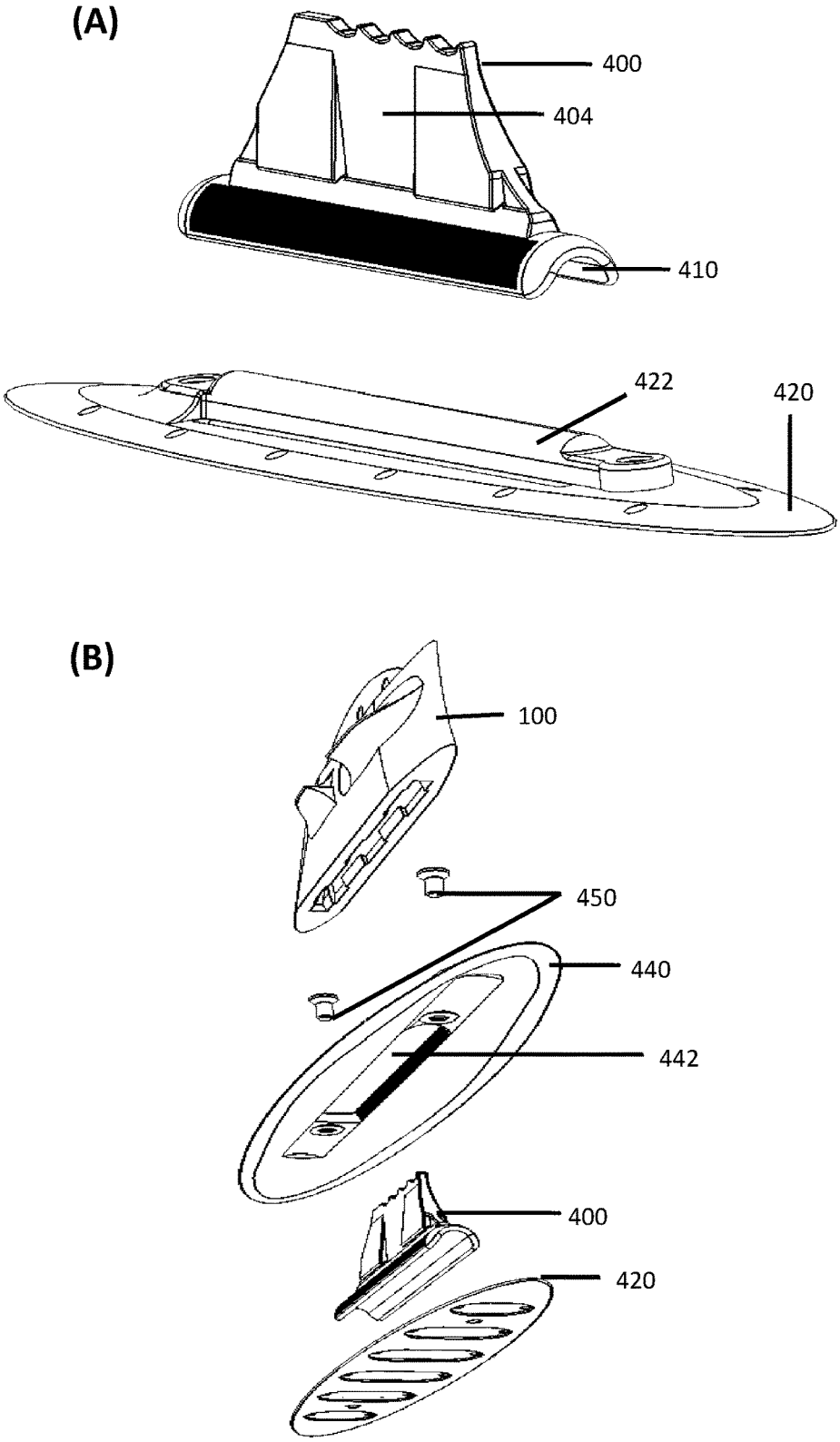
FIG. 9. is an illustration showing (A) an exploded perspective view of a base and base attachment plate; and (B) an exploded bottom perspective view of a preferred embodiment according to the second aspect of the adjustable fin of the invention.

An exploded view of the base 400 and base attachment plate 420 in FIG. 9A shows the base 400 comprises a saddle portion 410, the engagement surface of which substantially in the shape of a semi-cylindrical shell, extending longitudinally the length of the insert member 404. The saddle portion 410 pivotably engages with a semi cylindrical rod shaped projection 422 extending longitudinally on the base attachment plate 420.

The pivotable engagement of the base 400 at the saddle portion 410 with the base attachment plate 420 at the semi cylindrical rod shaped projection 422 is an important feature of this second aspect of the adjustable fin of the invention. In this regard, some shortboard surfboard shapers have been for many years including usually between 4 and 8 longitudinal bevels or 'channels' in the rear half of their board's underside. These channels are thought to increase board speed by directing water flow along the length of each channel toward the tail. "Hard channel bottoms", as developed by the shaper Allan Byrne, cut up to a half-inch into the bottom of the board, forming table-edged ridges that run all the way to the end of the tail. While interest in these channels has increased in recent times, one of the issues faced by shapers is in attaching the two or four side fins to the board within these channels at a suitable cant that matches the cant of the corresponding side fin on the opposite side of the stringer. This is due to the difficulty (or almost impossibility) in manually cutting channels into the board which exactly match corresponding channels on the board on the opposite side of the stringer or centre line in terms of the angle of the channel surface when measured perpendicular to the length of the channel. The pivotable engagement of the base 400 at the saddle portion 410 with the base attachment plate 420 at the semi cylindrical rod shaped projection 422, enables the shaper to adjust the cant of the base 400 and therefore fin section to a preferred angle which importantly, matches the corresponding side fin irrespective of the angle of the channel the base attachment plate 420 is attached to.

Once the shaper has pivotably adjusted the base 400 at the saddle portion 410 with the base attachment plate 420 at the semi cylindrical rod shaped projection 422 to the desired cant, the saddle portion 410 is secured to the semi cylindrical rod shaped projection 422. This preferably involves securing the saddle portion 410 to the semi cylindrical rod shaped projection 422 using small screws, though other known methods of securing a saddle to a rod may be employed.

Following attachment of the base attachment plate 420 to the external bottom surface of the surfboard; and securing the pivotably adjusted base 400 to the base attachment plate 420 at a desired cant; the base cover plate 440 is placed over the securely attached base 400 to base attachment plate 420. As shown in FIG. 9B, the base cover plate 440 comprises a centre hole 442 through which the insert member 404 of the base 400 can pass through so that the base cover plate 440 can contact and be secured to the base attachment surface by two screws 450.

The fin section 100 can then be coupled and securely engaged to the base 400 as described above to complete the embodiment of the adjustable fin of the invention according to the second aspect.

Further preferred embodiments of the adjustable fin of the invention according to the second aspect are shown in FIGS. 10 to 15.

Figure 10:
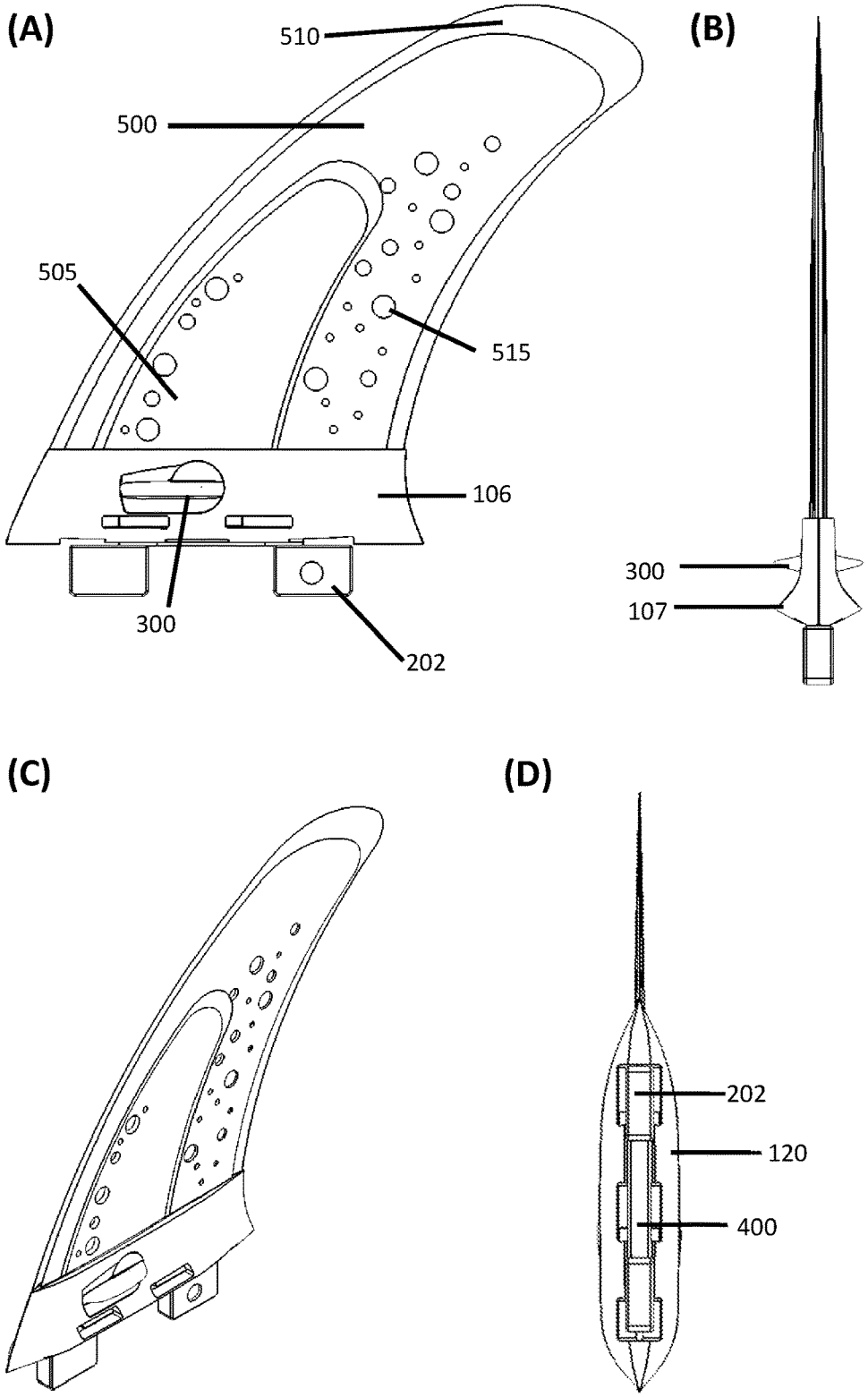
FIG. 10. is an illustration showing (A) a side view, (B) a front view, (C) a perspective view, and (D) a bottom view, of a further preferred embodiment according to the second aspect of the adjustable fin of the invention. Mounting means comprises mounting blocks which attach to FCS® fin plugs.
Figure 11:
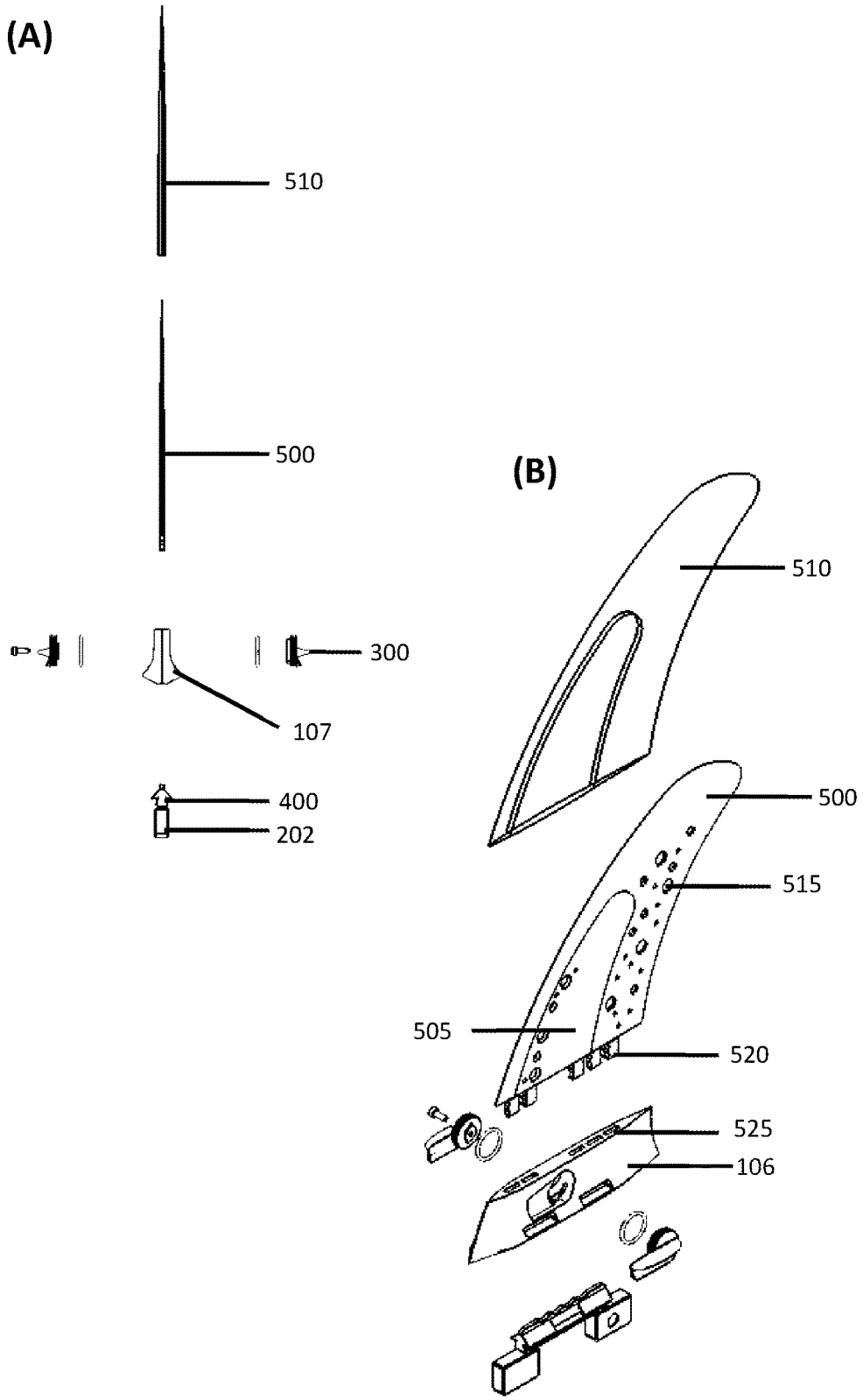
FIG. 11. is an illustration showing (A) an exploded front view, and (B) an exploded perspective view, of the embodiment shown in FIG. 10.

FIG. 10 shows collapsed views and FIG. 11 shows exploded views of an embodiment of the adjustable fin of the invention according to the second aspect, wherein the base comprises mounting blocks 202 that can attach to FCS® fin plugs. While the locking means comprises a knob 300, this embodiment does not comprise a ridge protruding from the outer fin surface 106. The outer fin surface 106 adjacent to the underside surface of the adjustable fin is not flared in this embodiment but forms a shape resembling a submarine from a view from the front (FIG. 10B). This 'submarine' shape comprises a ridge 107 from which the outer fin surface 106 between the ridge 107 and underside surface, angles toward the underside surface of the fin section in the location of the opening of the internal cavity.

FIG. 10A further shows an upper fin section attached to the bottom portion of the fin section, the upper fin section comprising a titanium alloy (comprising approximately 4% vanadium and approximately 6% aluminium) upper fin 500 covered with an overmolding 510 of protective safety polymer. The titanium alloy upper fin section is up to approximately 2 mm to 2.5 mm thick in the widest section 505 as compared to the thickness of approximately 6.5 mm to 8 mm of many commercially available fins. The titanium upper fin 500 has many beneficial features including its high tensile strength, it is of relatively low weight, a high rebound strength and an ineluctable quality to return to its original shape and position after flexing and the 'whip effect' this provides to assist the surfer to power out of turns on a board upon which one or more adjustable fin(s) of the invention are mounted. In normal surfing conditions, a surfer of approximately 85 kg surfing a shortboard with a 'thruster' fin setup, wherein the surfboard is travelling at approximately 7 m/s and turning sharply will exert approximately 400 N of force over the surface of the three fins. The titanium alloy upper fin 500 at a thickness of 2 mm to 2.5 mm is sufficient to handle such forces without breaking or permanently deforming, while providing some beneficial flex to provide additional power for the surfer as they come out of the turn.

The upper fin 500 shown in FIG. 11B comprises upper fin attachment members 520 which are received and restrained in cavities 525 to attach the upper fin 500 to the bottom portion of the adjustable fin. Adhesive may be used to restrain the upper fin attachment members 520 in the cavities 525. The embodiment shown in FIG. 11B comprises 5 upper fin attachment members 520 and 5 matching cavities 525. However, more or less than 5 upper fin attachment members may be used, and they may comprise a variety of different shapes and sizes with matching cavities that can receive and restrain the members.

The upper fin 500 shown in FIG. 10A also comprises circular holes 515 or cut outs of various sizes. These cut outs reduce the weight of the upper fin 500 further and assist in providing the beneficial flex characteristics for the adjustable fin of the invention. While the cut outs are circular in this embodiment, they may comprise a variety of different shapes. Furthermore, where the adjustable fin of the fin is in a dual fin arrangement, there will be no cut outs present in the position where the ribs or other attachment members attach the two fin sections.

In use, however, a thin titanium alloy upper fin 500 constitutes a potential hazard for persons if they came into contact with its sharp edges. In addition, three or four silver metal fins flashing through a wave on a sunny day has the potential to act as a lure for large ocean inhabitants. To address these potential hazards, the titanium alloy upper fin 500 is covered in a protective safety polymer by a method known as 'overmolding'. The polymer overmold 510 covers the sharp edges of the upper fin section therein protecting surfers from being cut by the metal in the upper fin 500, and is preferably of a colour or level of opacity which prevents the silver of the titanium from acting as a lure. The polymer overmold 510 increases the thickness or width of the fin at its widest point to approximately 3 mm to 3.5 mm.

Across the profile of the upper fin section is varying thickness to create a single or double sided fin foil as is known in the art and common to the shapes of surfboard fins, with a thicker section 505 toward the leading edge of the fin section which decreases in thickness with closer proximity to the trailing edge.

In the embodiment of the adjustable fin shown in FIGS. 10 and 11 and as shown in FIG. 11A, the base 400 and mounting blocks 202 form one piece and do not comprise separate components that have been attached.

Figure 12:
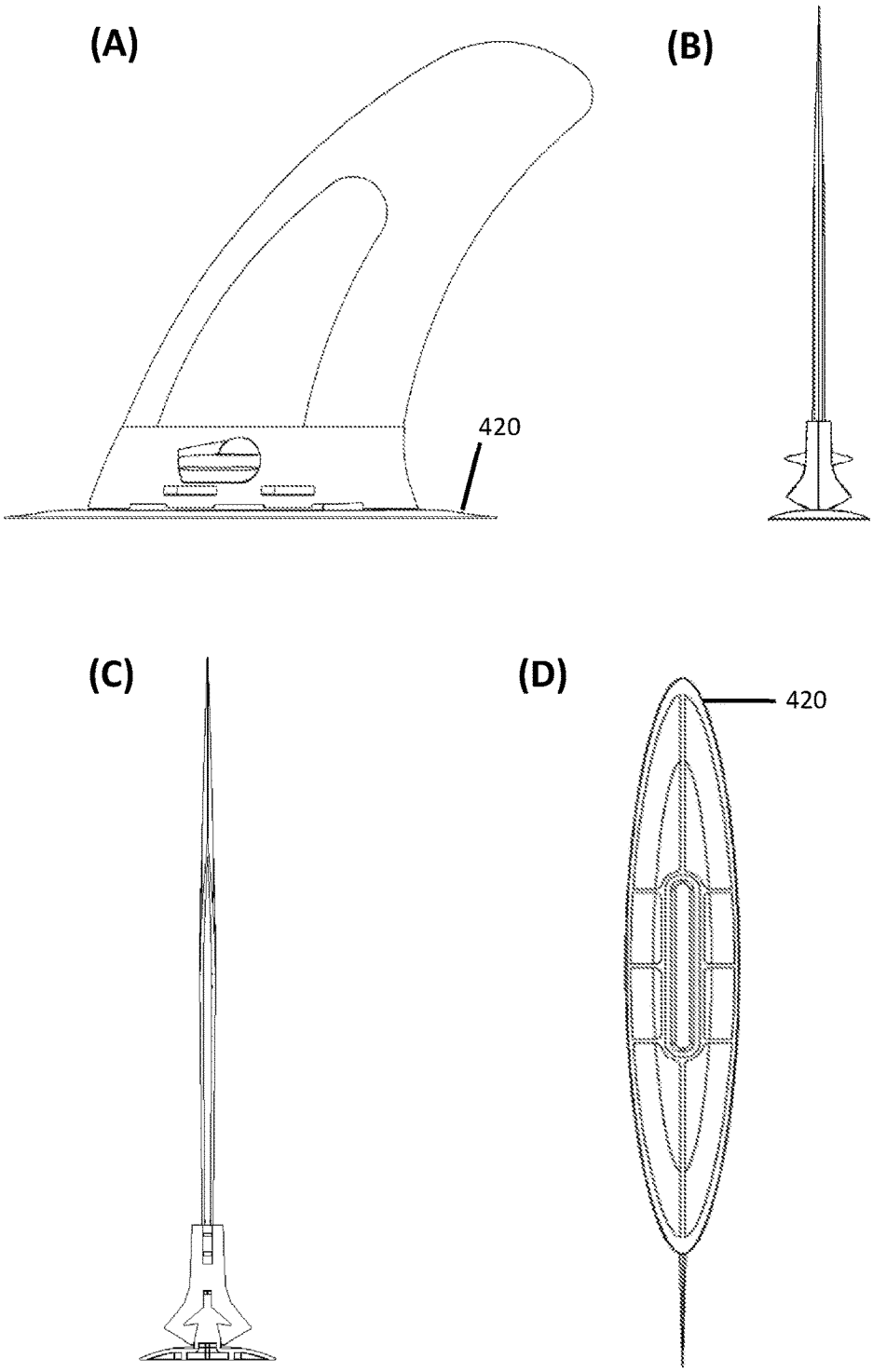
FIG. 12. is an illustration showing (A) a side view, (B) a front view, (C) a cross sectional front view, and (D) a bottom view, of a further preferred embodiment according to the second aspect of the adjustable fin of the invention.
Figure 13:
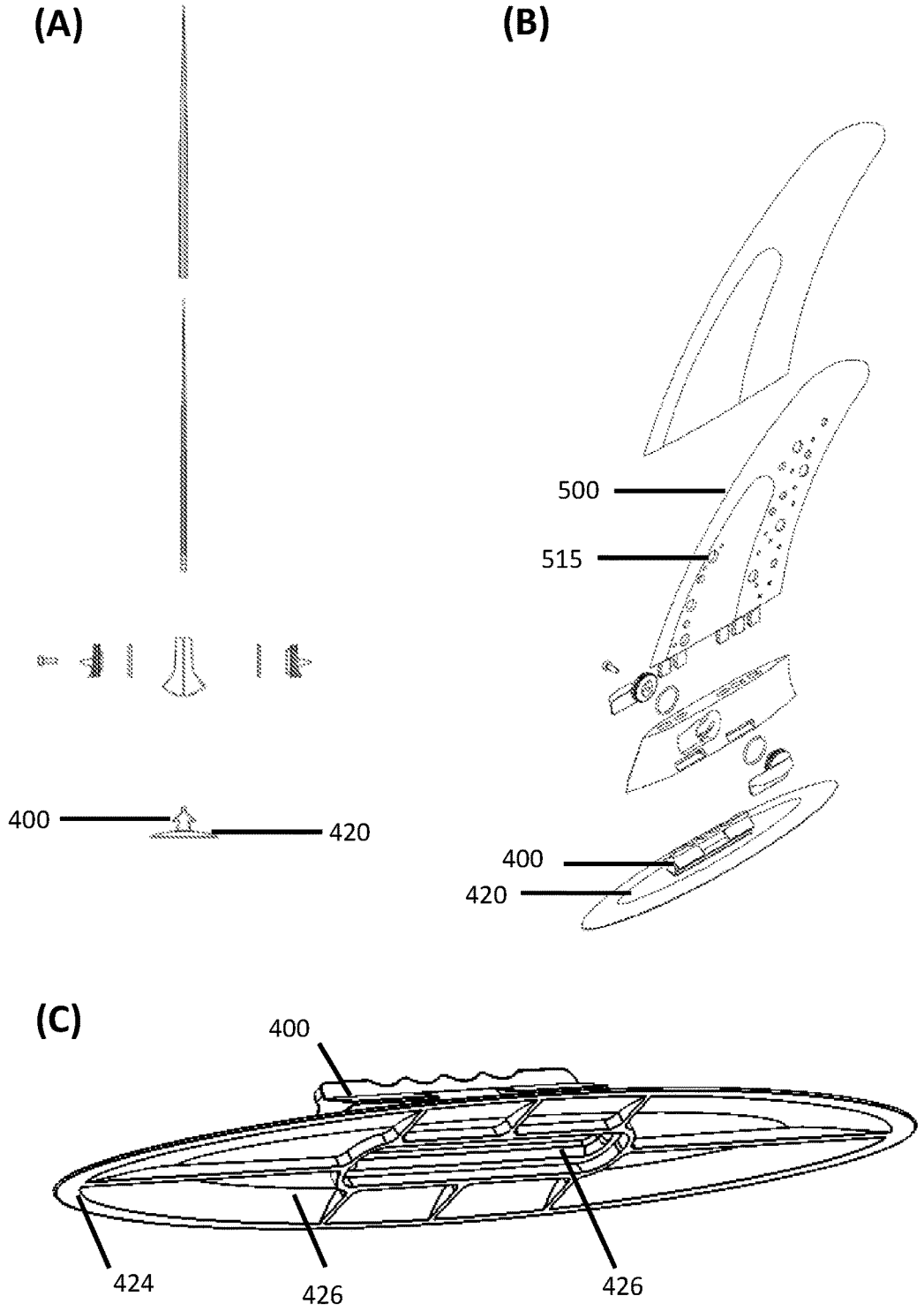
FIG. 13. is an illustration showing (A) an exploded front view, and (B) an exploded perspective view, of the embodiment shown in FIG. 12; and (C) an underside perspective view of the base of the embodiment.
Figure 14:
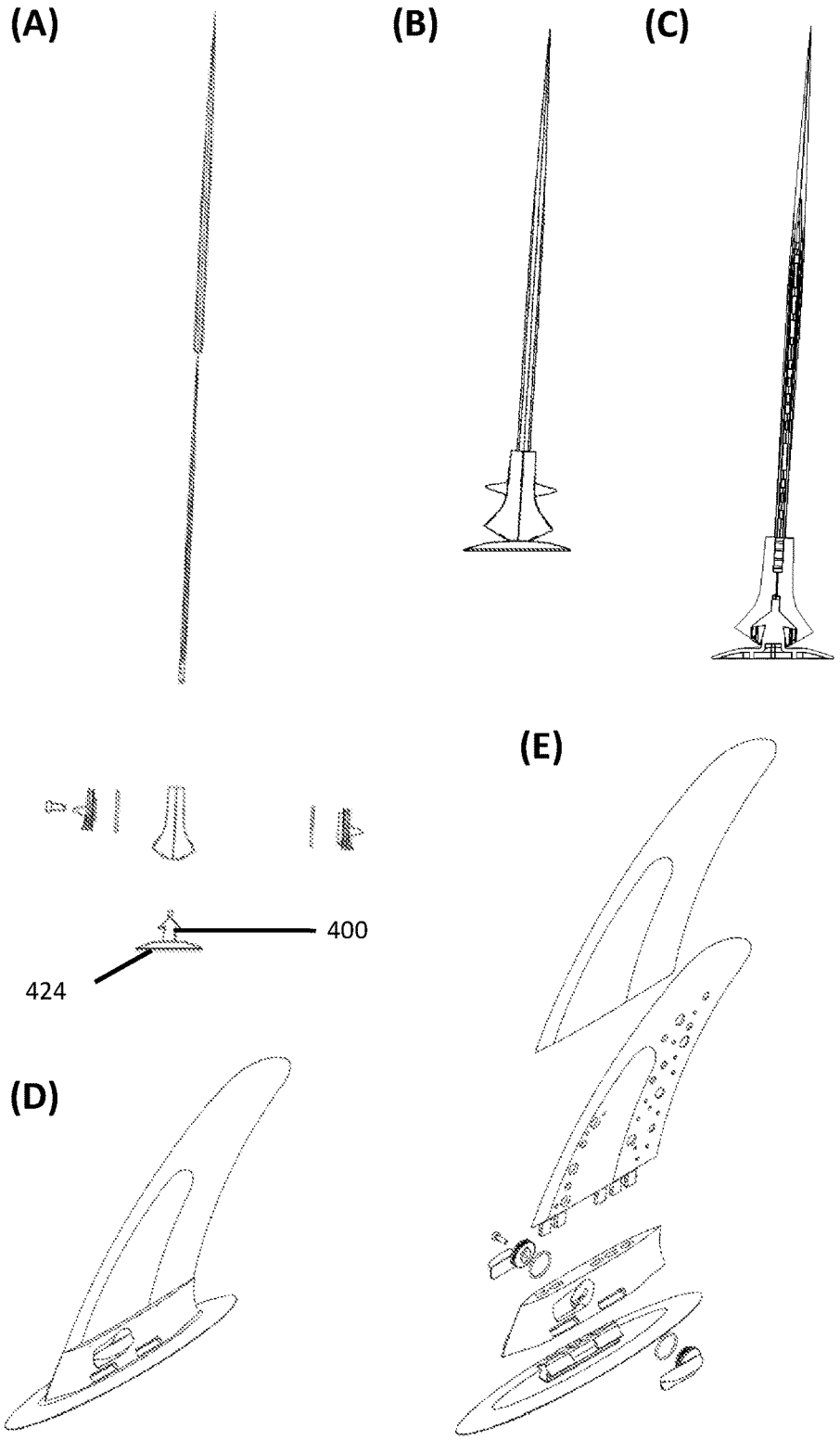
FIG. 14. is an illustration showing (A) an exploded front view, (B) a front view, (C) a cross sectional front view, (D) a perspective view, and (E) an exploded perspective view, of a further preferred embodiment according to the second aspect of the adjustable fin of the invention.

A further preferred embodiment of the adjustable fin of the invention according to the second aspect is shown in a collapsed form in FIG. 12, and an exploded form in FIG. 13. This embodiment is the same as the embodiment of the adjustable fin in FIGS. 10 and 11 with the exception that instead of mounting blocks attached to the base, the base 400 is attached to a base attachment plate 420 which comprises the mount in this embodiment for mounting onto the external bottom surface of a surfboard with adhesive and/or rovings, screws or other mechanical attachment means.

The underside of the base plate is shown in FIG. 13C showing the base attachment surface 424 and large cavities 426 for accommodating adhesive.

The holes 515 in the upper fin 500 can be seen in FIG. 13B but they are not visible in FIG. 12A due to the opacity of the overmold in this embodiment of the adjustable fin of the invention.

When mounted to a surfboard, the base of the embodiment of the adjustable fin of FIGS. 12 and 13 points away from the surfboard at an angle of approximately 90 degrees when measured from the external bottom surface of the surfboard on to which it is mounted. While being otherwise the same as the embodiment of FIGS. 12 and 13, the base of the embodiment of FIG. 14 points away from the surfboard at an angle of approximately 86.5 degrees (or approximately 3.5 degrees off 'centre' or 90 degrees) when measured from the external bottom surface of the surfboard on to which it is mounted. That is, the base 400 is 3.5 degrees off pointing in a direction perpendicular to the base attachment surface 424.

Figure 15:
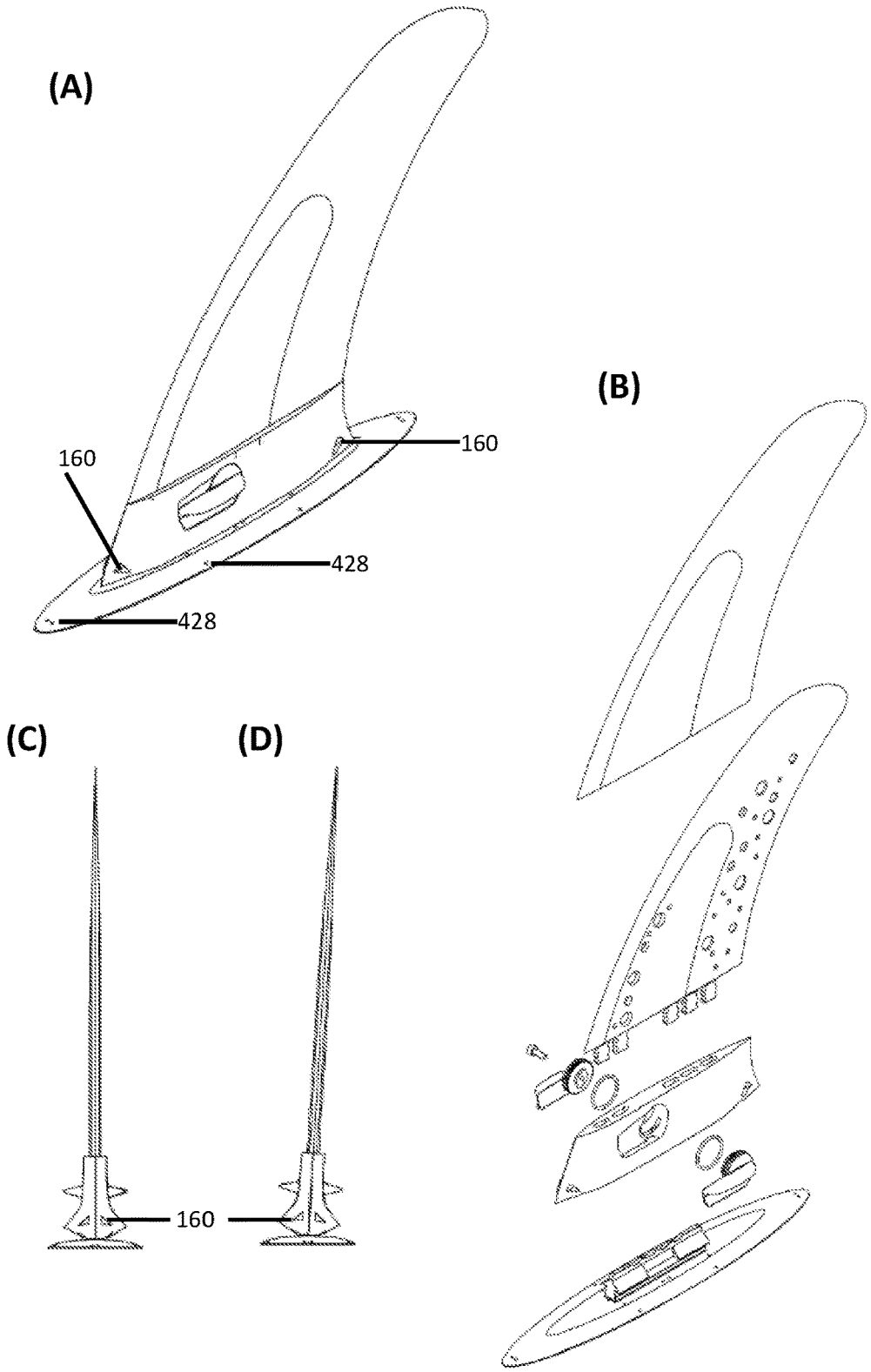
FIG. 15. is an illustration showing (A) a perspective view (B) an exploded perspective view, and (C) a front view, of an embodiment according to the second aspect of the adjustable fin of the invention; and (D) a front view, of a further embodiment according to the second aspect of the adjustable fin of the invention.

A further preferred embodiment of the adjustable fin of the invention according to the second aspect is shown in FIG. 15. This embodiment is similar to the embodiment shown in FIGS. 12 to 14 with a key difference that side shut-off cavities have been replaced with front and rear facing shut-off cavities 160. Another key difference is the presence of injection conduits 428 for injecting adhesive into the cavities or releasing air from the cavities as the adhesive fills the cavities 428, and/or for use as screw holes for attaching the adjustable fin to a surfboard with screw-type fasteners such as screws.

Figure 16:
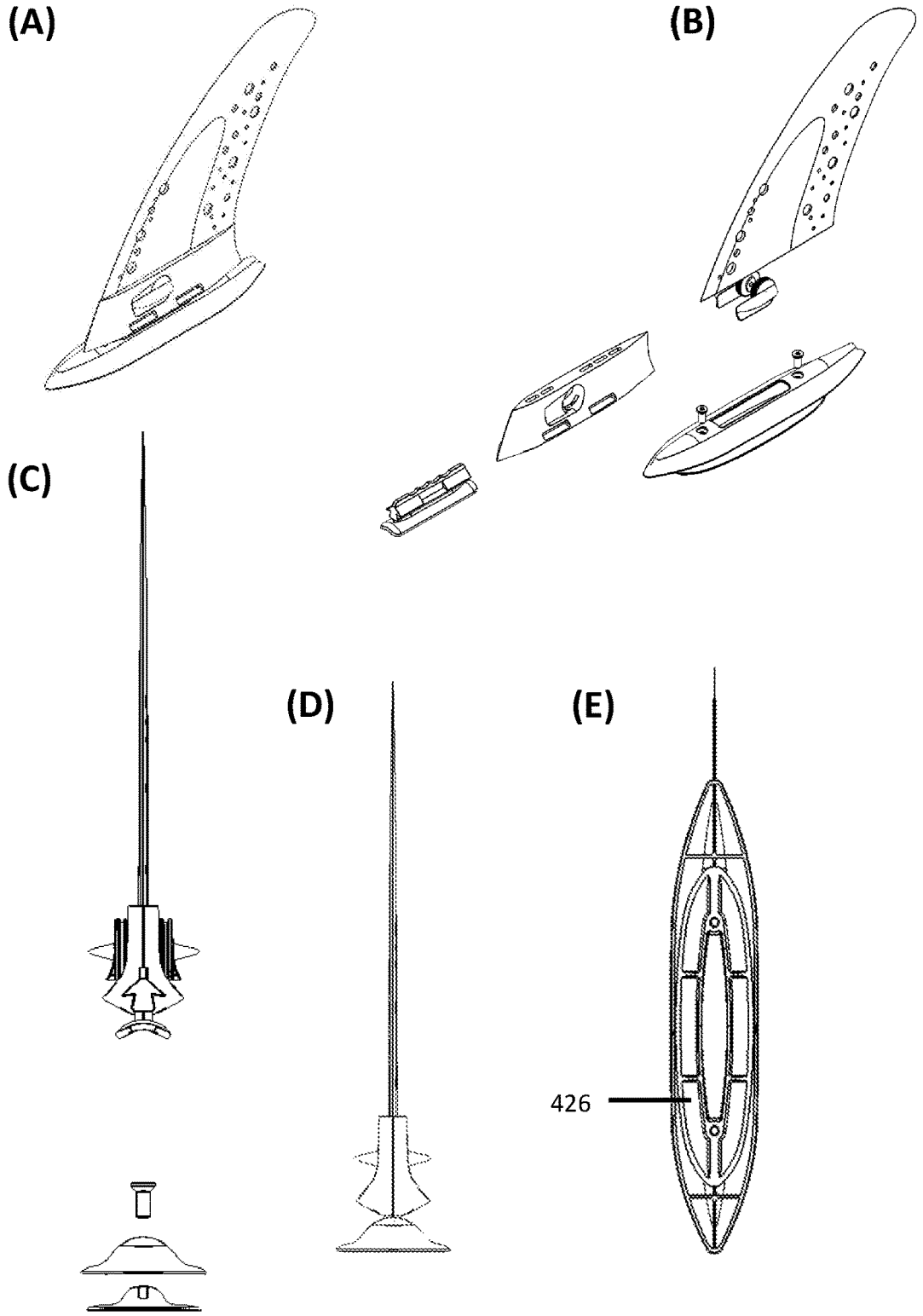
FIG. 16. is an illustration showing (A) a perspective view, (B) an exploded perspective view, (C) an exploded front view, (D) a front view, and (E) a bottom view, of an embodiment according to the second aspect of the adjustable fin of the invention.

FIG. 16 shows a further embodiment of the adjustable fin of the invention according to the second aspect wherein the fin section is the same as the fin section of the embodiments shown in FIGS. 10 to 14, but the base comprises a similar base assembly to the embodiment shown in FIGS. 6 to 9. A key difference between the base of the embodiment shown in FIG. 15 and the embodiment shown in FIGS. 6 to 9 include different shaped and larger volume cavities 426 for accommodating adhesive.

Figure 17:
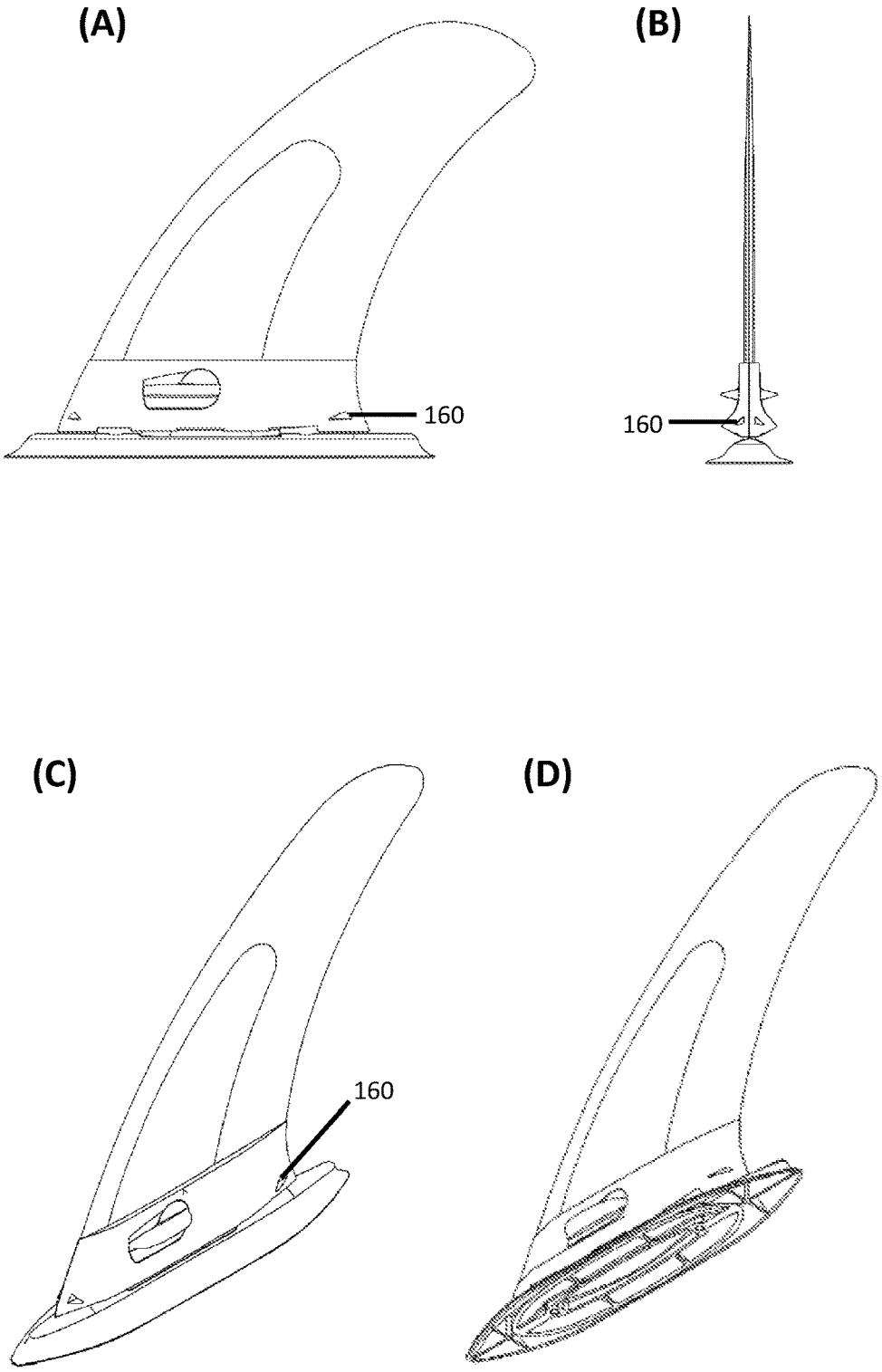
FIG. 17. is an illustration showing (A) a side view, (B) a front view, (C) a perspective view, (D) a bottom perspective view, of an embodiment according to the second aspect of the adjustable fin of the invention.
Figure 18:
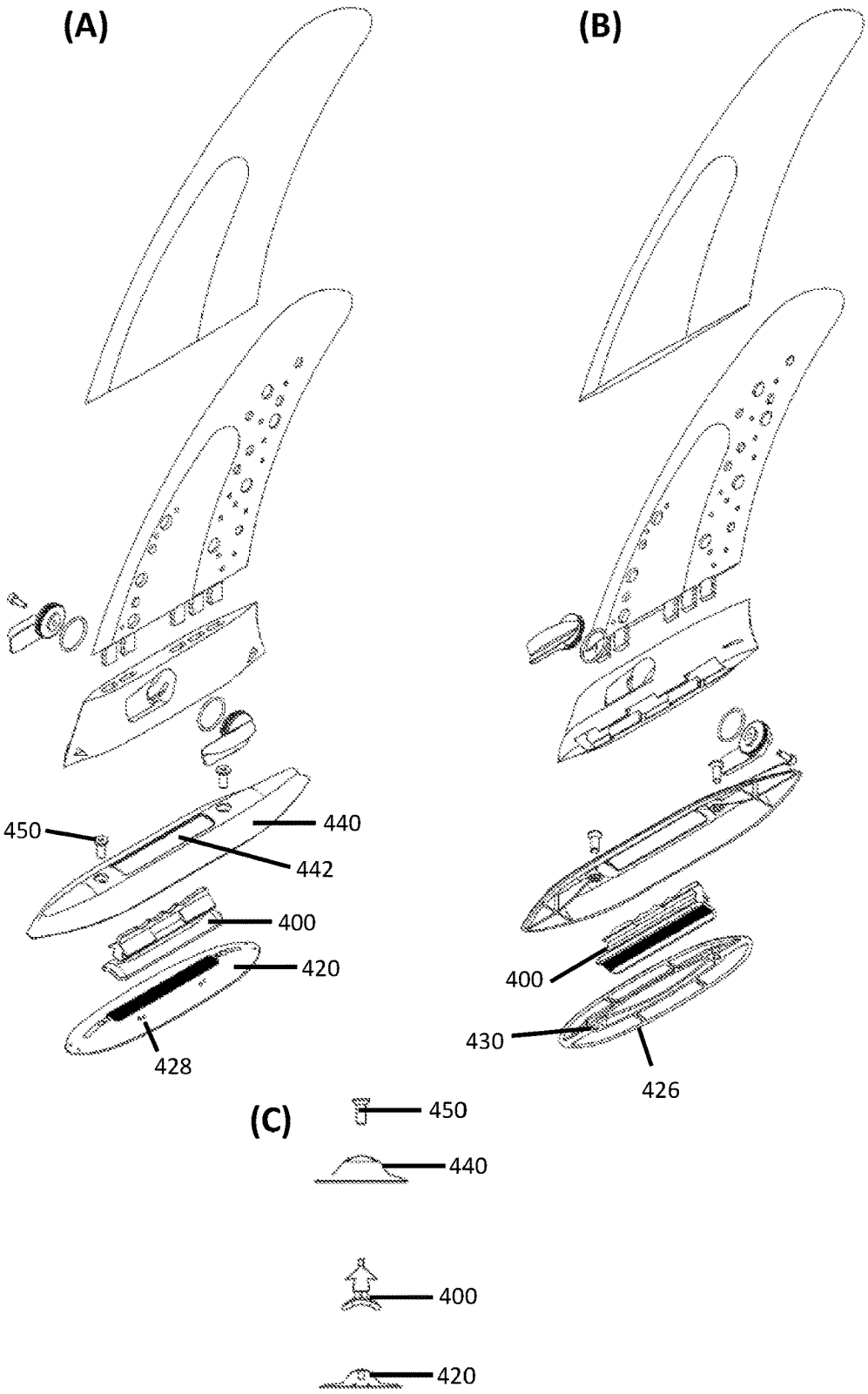
FIG. 18. is an illustration showing (A) an exploded perspective view, and (B) an exploded bottom perspective view, and (C) an exploded front view (of the base), of the embodiment shown in FIG. 17.

A further preferred embodiment of the adjustable fin of the invention according to the second aspect is shown in FIGS. 17 and 18. This embodiment is similar to the embodiment shown in FIGS. 12 to 14 (and with corresponding numbering) with key differences that side shut-off cavities have been replaced with front and rear facing shut-off cavities 160, and alternative shapes and volumes of the cavities 426.

Figure 19:
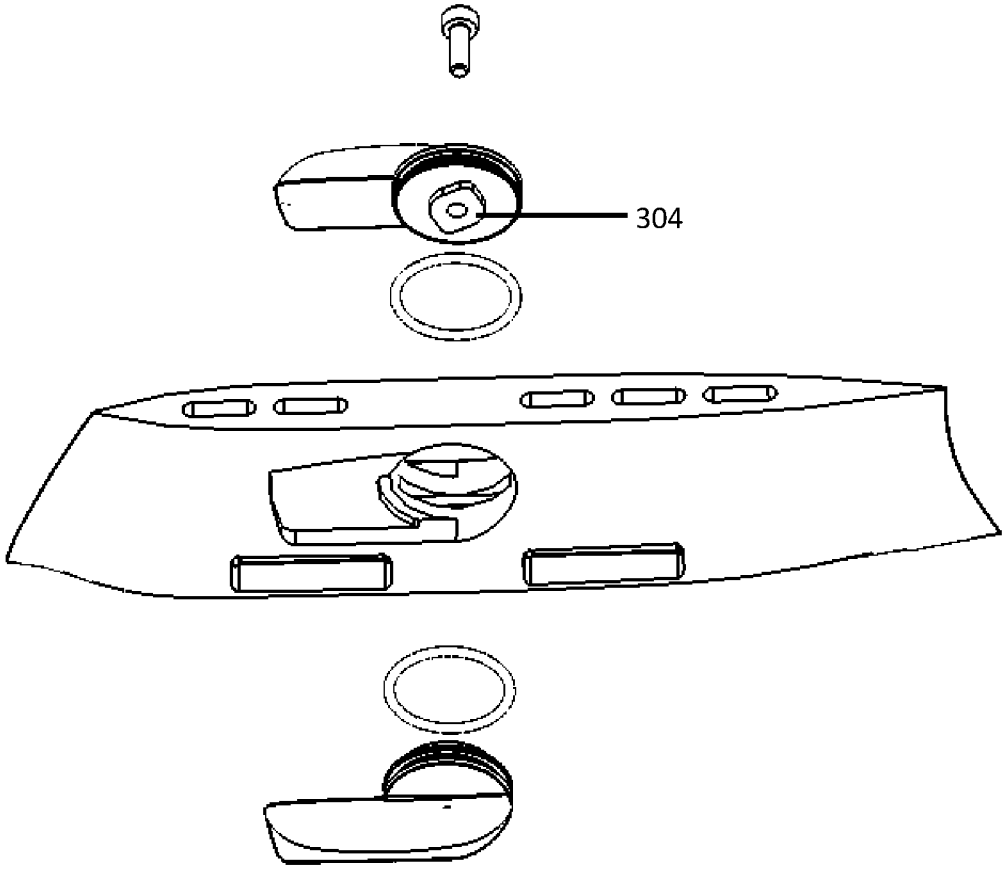
FIG. 19. is an illustration showing (A) an exploded side perspective view, (B) an exploded side perspective view, of the bottom portion of the fin section of the embodiment shown in FIGS. 10 to 15.
Figure 19:
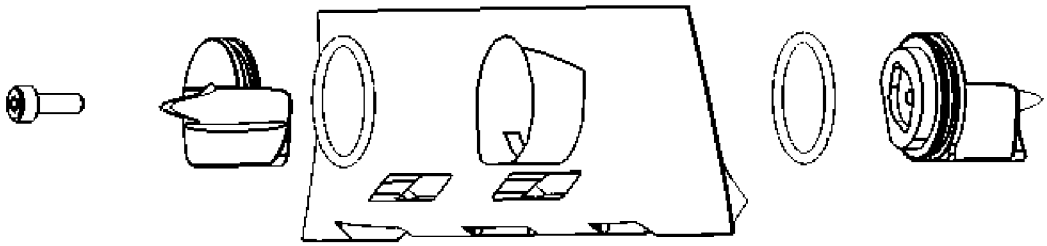

An exploded view of the parts of the locking means used in some preferred embodiments of the adjustable fin of the invention is shown in FIG. 19. The locking means comprises a cam 304 of a squarer configuration than the cam in the embodiment shown in FIG. 3.

Figure 20:
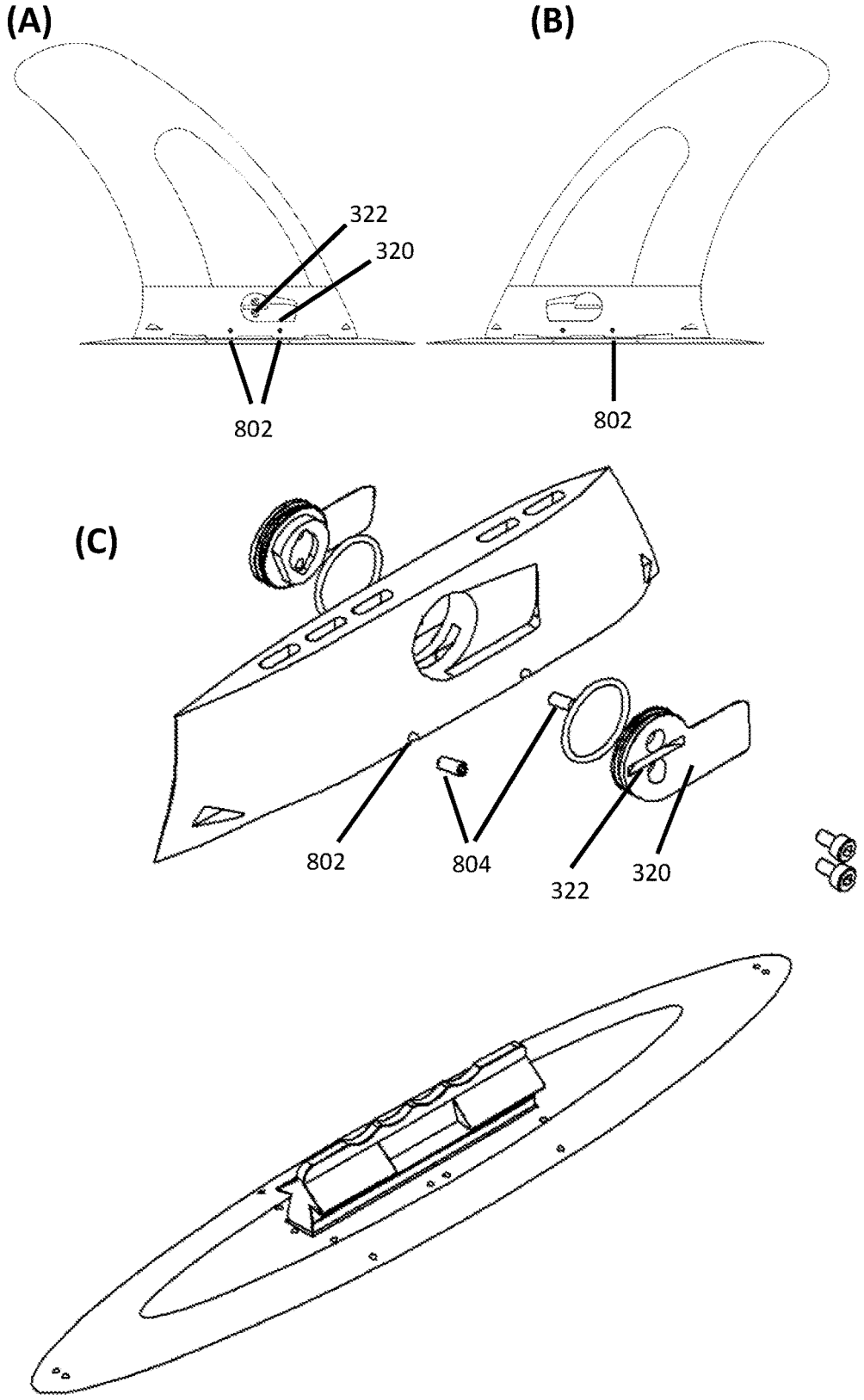
FIG. 20. is an illustration showing (A) a side view, (B) the alternative side view, (C) an exploded perspective view (excluding the upper fin portion), of an embodiment according to the second aspect of the adjustable fin of the invention.

A further embodiment of the adjustable fin of the invention according to the second aspect is shown in FIG. 20. This embodiment is similar to the embodiments shown in FIG. 15 with two key differences. The first key difference is that the knob 300 of the locking means is in the form of a plate 320 comprising a slot 322. The slot 322 can accommodate part of a coin or another similarly shaped object, and the plate 320 and therefore the locking means and cam 304 can be turned by turning the coin in the slot 322. The range of rotation of the plate 320 is approximately the same as for the herein described knob. While the knob provides the benefit of not requiring tools or other implements to adjust the fin, for example, in the water, the plate 320 comprising the slot 322 for a coin has a benefit of being able to sit almost flush against the side of the fin section resulting in less drag, and some users may find it easier to turn the locking means with a coin than with their fingers.

The second key difference is that the embodiment shown in FIG. 20 comprises four locking holes 802 (two per side) in the bottom portion of the outer fin sections, the locking holes 802 accommodating locking screws 804 which can be screwed in by a user to further 'lock' the adjustable fin into an adjusted position, or unscrewed to enable normal adjustment of the fin relative to the base as described herein.

Third Aspect of the Invention

Figure 21:
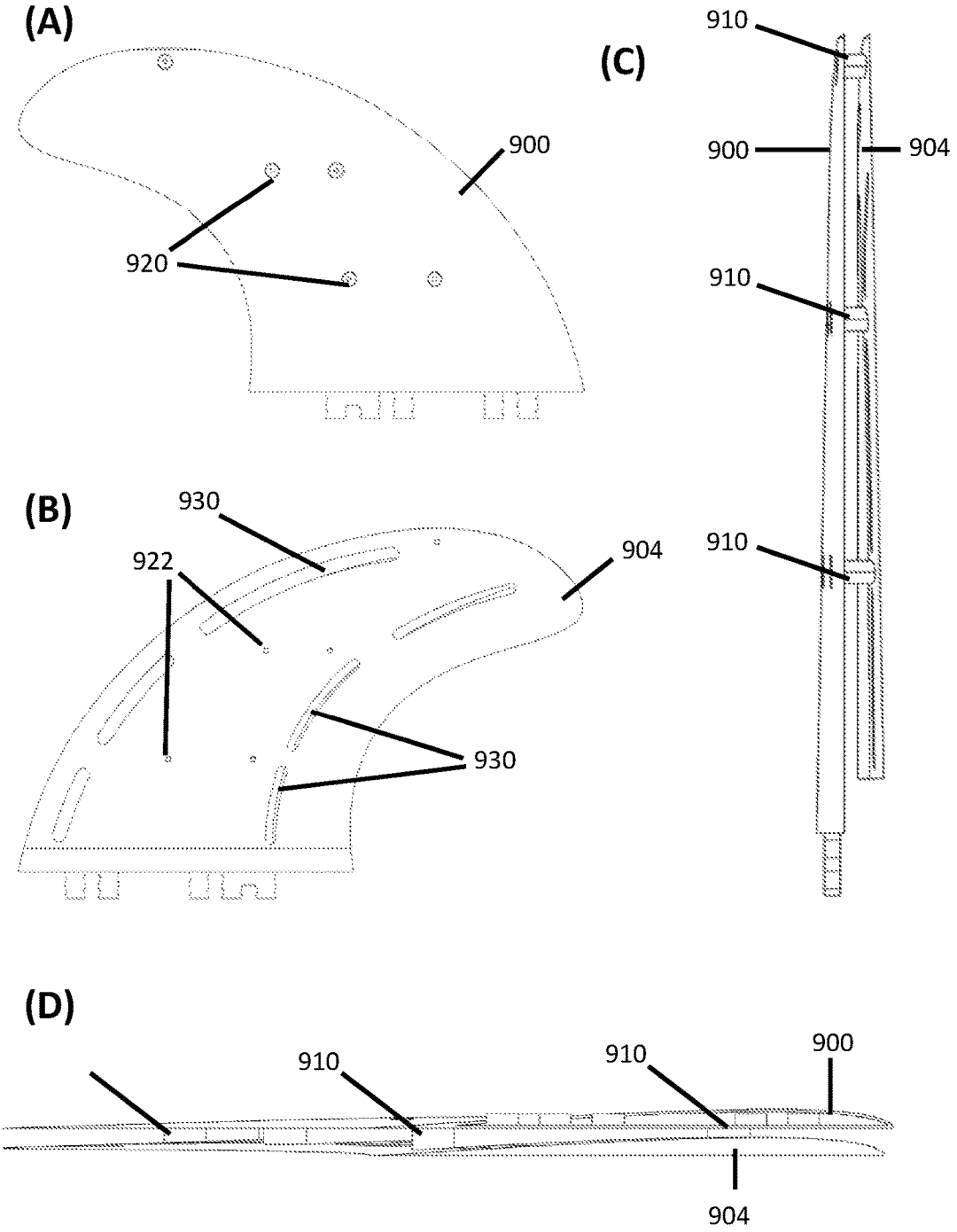
FIG. 21. is an illustration showing (A) a side view, (B) the alternative side view, (C) a front view, and (D) a bottom view, of an embodiment according to the third aspect of the adjustable fin of the invention.
Figure 22:
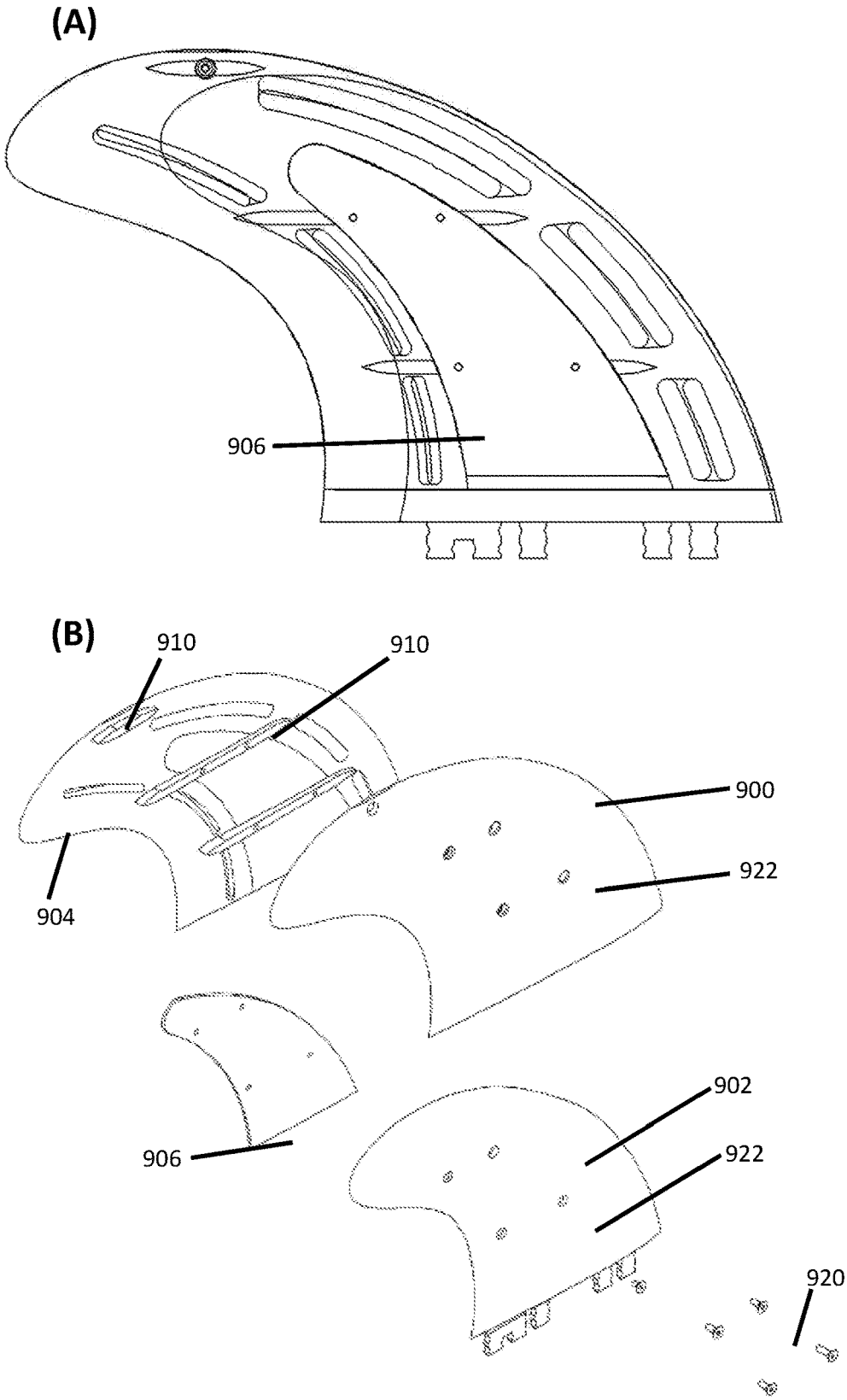
FIG. 22. is an illustration showing (A) a side cutaway view, and (B) an exploded perspective view, of the embodiment shown in FIG. 21.

An embodiment of the upper fin portion of the adjustable fin of the invention according to the third aspect is shown in FIGS. 21 and 22. This upper dual fin comprises an upper portion 900 of a fin section comprising a first titanium fin portion 902. The upper portion 900 is attached to a second fin section 904 with three ribs 910 as attachment means. The second fin section 904 comprises a second titanium fin portion 906. The two ribs 910 closest to the base are attached to the first titanium fin portion 902 and the second titanium fin portion 906 with screws 920 driven through screw holes in the titanium fin portions and the two ribs 910 to provide a strong attachment of the fin sections. The upper portion 900 and the second fin section 904 comprise flat foils and may be used as side fins on a surfboard.

The screws 920 may be removed to separate the upper portion 900 from the second fin section 904 and the ribs 910 so that the upper portion 900 (attached to a bottom portion of a fin section and a base) may be used as a single adjustable fin. Alternatively, an adjustable fin comprising the upper portion 900 may be purchasable separately to the second fin section 904, ribs 910, and screws 920, with the dual fin formed by a user by screwing on to the upper portion, the ribs 910 and the second fin section 904.

Passages 930 in the second fin section 904 direct water passing through them into the region between the flat foils to increase the water pressure in this region as described herein.

The titanium fin portions may contains cut-outs, for example, holes as described herein. However, these cut-outs will preferably not be in close proximity to the rib screws so as to not potentially weaken the titanium fin portion near the dual fin attachment sites.

What is claimed is:

1. A fin for use on a surfboard, the fin comprising:

a base comprising a mount for attaching the fin to a surfboard; and the base comprising an insert member extending in a direction contrary to the mount;

a fin section comprising two outer fin surfaces which meet at a leading edge and a trailing edge;

the fin section comprising an underside surface comprising an opening to an internal cavity within the fin section, the internal cavity within the fin section configured to house the insert member of the base and enable slidable movement of the insert member in a direction towards the leading edge or the trailing edge;

wherein the base is coupled to the fin section by at least a portion of a sliding joint; and wherein the fin section comprises a lock that is manipulable and which projects into the internal cavity, wherein the lock can releasably couple to the insert member at one or more locking positions thereby preventing slidable movement of the insert member.

2. The fin according to claim 1, wherein the base can be uncoupled from the fin section by slidable movement of the fin section relative to the base.

3. The fin according to claim 2, wherein the sliding joint comprises at least a wall and a portion of the base of a tongue slidably engaged with at least a wall and a portion of the base of a groove.

4. The fin according to claim 3, wherein the base comprises at least a wall and a portion of the base of the groove on either side of the insert member, and the fin section comprises at least the walls and a portion of the base of the tongue.

5. The fin according to claim 4, wherein the fin section comprises a wall and at least a portion of the base of the tongue on opposing sides of the internal cavity.

6. The fin according to claim 4, wherein the sliding joint comprises a sliding dovetail joint, and the base comprises at least a wall and a portion of the base of a sliding dovetail groove on either side of the insert member, and the fin section comprises at least the walls and a portion of the base of a dovetail tongue.

7. The fin according to claim 6, wherein the fin section comprises at least a wall and a portion of the base of the dovetail tongue on opposing sides of the internal cavity and adjacent to the underside surface of the internal cavity.

8. The fin according to claim 3, wherein the fin section comprises at least a wall and a portion of the base of the groove on opposing sides of the internal cavity, and the insert member comprises at least a wall and a portion of the base of the tongue either side of the insert member.

9. The fin according to claim 8, wherein the sliding joint comprises a sliding dovetail joint, and the fin section comprises at least a wall and a portion of the base of a sliding dovetail groove on opposing sides of the internal cavity, and the insert member comprises at least a wall and a portion of the base of the dovetail tongue either side of the insert member.

10. The fin according to claim 3, wherein the base can be uncoupled from the fin section by slidable movement of the at least walls and a portion of the base of the tongue into a gap in the at least walls and a portion of the base of the groove.

11. The fin according to claim 1, wherein the lock comprises a knob that is accessible for a user at an outer fin surface to manipulate the lock, and turning the knob uncouples or recouples the lock to the insert member.

12. The fin according to claim 11, wherein the fin section is configured to adjust relative to the base by manipulating the lock by turning the knob to uncouple the lock from the insert member at a first locking position, slidably moving the insert member through the internal cavity, and turning the knob to releasably couple the lock to the insert member at a second locking position.

13. The fin according to claim 12, wherein the knob can be finger turned by a user.

14. The fin according to claim 1, wherein the insert member comprises at least two teeth, and a valley between two teeth forms a locking position.

15. The fin according to claim 14, wherein the at least two teeth are located at an end of the insert member and extend in a direction contrary to the mount.

16. The fin according to claim 14, wherein the lock comprises a cam which is received at a locking position in a valley thereby coupling the lock to the insert member, and turning the knob moves the cam out of the valley and the locking position, thereby uncoupling the lock from the insert member and enabling slidable movement of the insert member through the internal cavity.

17. The fin according to claim 16, wherein following slidable movement of the insert member through the internal cavity, turning the knob moves the cam into the same or a different valley and a locking position, thereby recoupling the lock to the insert member.

18. The fin according to claim 1, wherein the base comprises:

a base attachment plate comprising a substantially flat base attachment surface which contacts the external bottom surface of a surfboard to which it is mounted; and wherein the base attachment plate is attached to the external bottom surface of the surfboard with adhesive and/or screws.

19. The fin according to claim 1, wherein the mount comprises one or more mounting blocks capable of attaching to commercially available fin plug and fin box systems.

20. The fin according to claim 1, wherein a second fin section is directly attached to the fin section, or the second fin section is attached to the fin section by one or more rods, plates, pins, bars, and/or ribs.

21. The fin according to claim 1, wherein a portion of the fin comprises titanium and/or a titanium alloy.

22. The fin according to claim 1, for mounting to any one of the boards in the group comprising: surfboard, shortboard, kneeboard, longboard, minimal, soft board, kiteboard, wind surfer, stand up paddleboard, wakeboard, rescue board, bodyboard, or another board used in surface water sports or activities.

23. A process comprising the step of mounting the fin according to claim 1, to any one of the boards in the group comprising: surfboard, shortboard, kneeboard, longboard, minimal, soft board, kiteboard, wind surfer, stand up paddleboard, wakeboard, rescue board, bodyboard, or another board used in surface water sports or activities.

* * * * *